US011673390B2

(12) United States Patent
Ishizaki et al.

(10) Patent No.: US 11,673,390 B2
(45) Date of Patent: Jun. 13, 2023

(54) HEAD SYSTEM, LIQUID SUPPLY SYSTEM, PRINTING APPARATUS, AND LIQUID FLOW METHOD

(71) Applicant: BROTHER KOGYO KABUSHIKI KAISHA, Nagoya (JP)

(72) Inventors: Hirotoshi Ishizaki, Nagakute (JP); Itsuki Morimoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 34 days.

(21) Appl. No.: 17/209,883

(22) Filed: Mar. 23, 2021

(65) Prior Publication Data

US 2021/0300037 A1 Sep. 30, 2021

(30) Foreign Application Priority Data

Mar. 30, 2020 (JP) ..... JP2020-059583
Sep. 30, 2020 (JP) ..... JP2020-164332

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2/175; B41J 2/18; B41J 2202/12; B41J 2/14233; B41J 2/01; B41J 2/17566
See application file for complete search history.

(56) References Cited

U.S. PATENT DOCUMENTS

2012/0218355 A1 8/2012 Suzuki et al.
2013/0271529 A1 10/2013 Domae et al.
2015/0049143 A1 2/2015 Hirai et al.
2015/0091991 A1 4/2015 Hayashi
2015/0352855 A1 12/2015 Nawano et al.
(Continued)

FOREIGN PATENT DOCUMENTS

EP 3 461 641 A1 4/2019
JP 2012-171255 A 9/2012
(Continued)

OTHER PUBLICATIONS

IP.com search (Year: 2022).*
(Continued)

*Primary Examiner* — Lisa Solomon
(74) *Attorney, Agent, or Firm* — Merchant & Gould P.C.

(57) ABSTRACT

There is provided a head system including a head; a supply channel; and a discharge channel. The head has four groups each including a manifold extending in a first direction. The four groups include a first to fourth groups arranged in a second direction intersecting the first direction. The supply channel is connected to the one end of the manifold included in each of two groups and is connected to the opposite end of the manifold included in each of remaining two groups, the two groups constituting a group A and the remaining two groups constituting a group B. The discharge channel is connected to the opposite end of the manifold included in each of the two groups constituting the group A and is connected to the one end of the manifold included in each of the two groups constituting the group B.

27 Claims, 17 Drawing Sheets

(56) References Cited

U.S. PATENT DOCUMENTS

| | | | |
|---|---|---|---|
| 2016/0288499 | A1 | 10/2016 | Sugahara et al. |
| 2020/0031134 | A1 | 1/2020 | Mizuno |
| 2021/0300038 | A1 | 9/2021 | Morimoto et al. |

FOREIGN PATENT DOCUMENTS

| | | | |
|---|---|---|---|
| JP | 2013-193371 | A | 9/2013 |
| JP | 2015-36218 | A | 2/2015 |
| JP | 2015-85683 | A | 5/2015 |
| JP | 2015-231723 | A | 12/2015 |
| JP | 2018-134880 | A | 8/2018 |
| WO | 2019/130532 | A1 | 7/2019 |

OTHER PUBLICATIONS

Extended European Search Report issued in corresponding European Patent Application No. 21164558.5, dated Aug. 12, 2021.
Extended European Search Report issued in related European Patent Application No. 21164557.7, dated Aug. 12, 2021.
Office Action issued in corresponding U.S. Appl. No. 17/209,947, dated Sep. 12, 2022.
Notice of Allowance issued in related U.S. Appl. No. 17/209,947, dated Mar. 6, 2023.

* cited by examiner

HEAD SYSTEM, LIQUID SUPPLY SYSTEM, PRINTING APPARATUS, AND LIQUID FLOW METHOD

CROSS REFERENCE TO RELATED APPLICATION

The present application claims priority from Japanese Patent Application Nos. 2020-059583, filed on Mar. 30, 2020 and 2020-164332, filed on Sep. 30, 2020, the disclosure of which is incorporated herein by reference in its entirety.

BACKGROUND

The present disclosure relates to a head system, a liquid supply system, a printing apparatus, and a liquid flow method.

There is an image recording apparatus, which records an image by ejecting (discharging) a liquid such as an ink or the like to a medium such as recording paper or the like by means of a liquid ejection (discharge) head. In general, the liquid ejection head is provided with a large number of pressure chambers which accommodate the liquid, a large number of nozzles which are connected to the large number of pressure chambers respectively, channels which distribute the liquid to the large number of pressure chambers, and actuators which apply the pressure to the pressure chambers (see, for example, Japanese Patent Application Laid-open No. 2015-36218). The ejection of the liquid is performed by the liquid ejection head by raising the internal pressure of any desired pressure chamber by using the actuator so that the ink is extruded from the nozzle connected to the pressure chamber.

SUMMARY

The inventors of the present disclosure have diligently investigated the quality of the image formed by the existing liquid ejection head and founded out that the deterioration of the image quality may occur resulting from the temperature change of the liquid.

An object of the present disclosure is to provide a head system, a liquid supply system, a printing apparatus, and a liquid flow method which make it possible to suppress any deterioration of the image quality that would be otherwise caused by the temperature change of the liquid.

According to a first aspect of the present disclosure, there is provided a head system including:

a head;

a supply channel which has a supply port configured to receive a liquid, and which extends between the supply port and the head; and a discharge channel which has a discharge port configured to discharge the liquid and which extends between the discharge port and the head, wherein:

the head has four groups each including a manifold extending in a first direction and a plurality of pressure chambers each connected to the manifold and a nozzle;

the four groups include a first group, a second group, a third group and a fourth group arranged in an order of the first group, the second group, the third group, and the fourth group in a second direction intersecting the first direction;

one end of the manifold included in each of the four groups is positioned on a first side in the first direction, and an opposite end of the manifold included in each of the four groups is positioned on a second side in the first direction;

the supply channel is connected to the one end of the manifold included in each of two groups of the four groups and is connected to the opposite end of the manifold included in each of remaining two groups of the four groups, the two groups constituting a group A and the remaining two groups constituting a group B;

the discharge channel is connected to the opposite end of the manifold included in each of the two groups constituting the group A and is connected to the one end of the manifold included in each of the two groups constituting the group B; and the first group and the third group constitute the group A and the second group and the fourth group constitute the group B, or the first group and the fourth group constitute the group A and the second group and the third group constitute the group B.

According to a second aspect of the present disclosure, there is provided a liquid supply system including:

the head system of the first aspect;

a supply tank connected to the supply channel;

a discharge tank connected to the discharge channel; and a differential pressure mechanism configured to generate a differential pressure between the supply tank and the discharge tank.

According to a third aspect of the present disclosure, there is provided a printing apparatus including:

the liquid supply system of the second aspect; and a medium conveyer configured to convey a medium.

According to a fourth aspect of the present disclosure, there is provided a liquid flow method for causing a liquid to flow through a head;

the head having four groups each including a manifold extending in a first direction and a plurality of pressure chambers each connected to the manifold and a nozzle;

the four groups including a first group, a second group, a third group and a fourth group arranged in an order of the first group, the second group, the third group, and the fourth group in a second direction intersecting the first direction, the method comprising:

causing the liquid to flow from a first side to a second side in the first direction in the manifold included in each of two groups, of the four groups, constituting a group A;

causing the liquid to flow from the second side to the first side in the first direction in the manifold included in each of remaining two groups, of the four groups, constituting a group B;

the first group and the third group constitute the group A and the second group and the fourth group constitute the group B, or the first group and the fourth group constitute the group A and the second group and the third group constitute the group B.

EMBODIMENTS

First Embodiment

An explanation will be made with reference to FIGS. 1 to 9 about a head system HS1 (FIG. 2), an ink supply system ISS1, a printing apparatus 1000, and an ink flow method according to a first embodiment of the present disclosure.

<Printer 1000>

Figure 1:
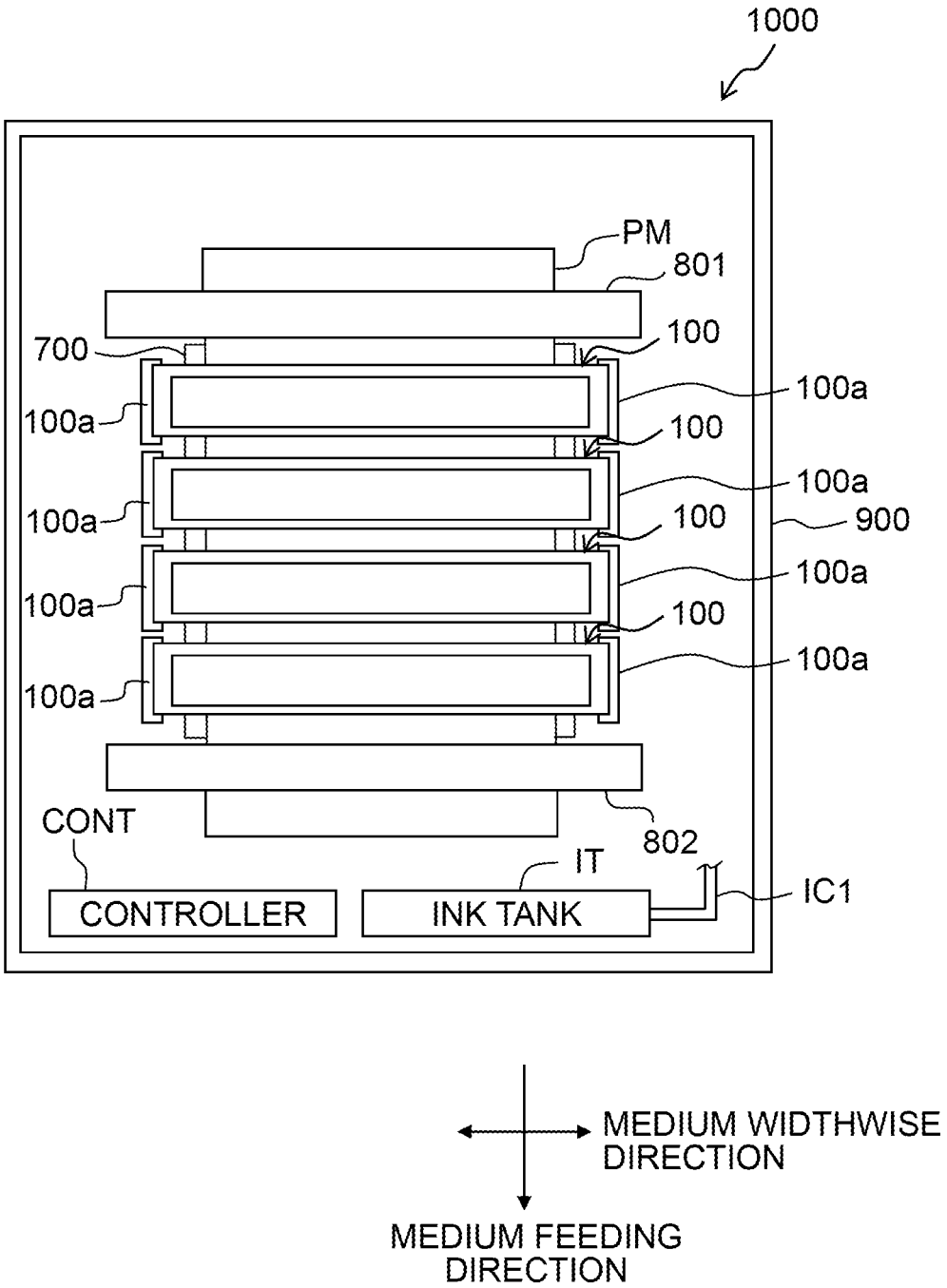
FIG. 1 depicts a schematic structure of a printer.

As depicted in FIG. 1, the printer 1000 is principally provided with four head units 100, a platen 700, a pair of conveying rollers 801, 802, an ink tank IT, a controller CONT, and a casing 900 for accommodating these components. In addition, one subtank (fill tank, supply tank) ST (FIG. 2) and one drain tank (recovery tank) DT (FIG. 2) are provided for each of the four head units 100 at the inside of the casing 900.

In the following explanation, the direction in which the pair of conveying rollers 801, 802 are aligned, i.e., the direction in which a medium PM is conveyed during the image formation is referred to as "medium feeding direction" of the printer 1000. As for the "medium feeding direction", the upstream side in the direction in which the medium PM is conveyed is referred to as "supply side", and the downstream side is referred to as "discharge side".

Further, the direction, in the horizontal plane, orthogonal to the medium feeding direction, i.e., the direction in which the rotation axes of the conveying rollers 801, 802 extend is referred to as "medium widthwise direction". As for the "medium widthwise direction", the left side and the right side, which are provided when the supply side is viewed from the discharge side in the medium feeding direction, are referred to as "left side" and "right side" in the medium widthwise direction. The direction, which is orthogonal to the "medium feeding direction" and the "medium widthwise direction", is referred to as "upward-downward direction".

The "upstream side" and the "downstream side", which are referred to in the explanation about the channel in this specification, mean the upstream side and the downstream side in the flow direction of the liquid flowing through the inside of the channel.

Each of the four head units 100 is a so-called line type head which is supported by a support member 100*a* at both end portions in the medium widthwise direction. In this embodiment, the four head units 100 are configured so that mutually different four color inks are ejected. The four colors are, for example, cyan, magenta, yellow, and black. Specified structures and functions of the respective head units 100 will be described later on.

The platen 700 is a plate-shaped member which supports the medium PM from the side (lower side) opposite to the head unit 100 when the ink is ejected from the head unit 100 toward the medium PM. The width of the platen 700 in the medium widthwise direction is larger than the width of the largest medium on which the image can be recorded by the printer 1000.

The pair of conveying rollers 801, 802 are arranged while interposing the platen 700 in the medium feeding direction. The pair of conveying rollers 801, 802 feed the medium PM to the discharge side in the medium feeding direction in a predetermined mode when the image is formed on the medium PM by the head units 100. The conveying rollers 801, 802 are examples of the "medium conveyer" of the present disclosure.

The ink tank IT is comparted into four so that the four color inks can be accommodated. One subtank ST and one drain tank DT are provided over or above each of the head units 100.

The ink tank IT is connected to the four subtanks ST by the aid of ink channel members IC1. One ink channel member IC1 is provided for the subtank ST, i.e., one ink channel member IC1 is provided for each of the colors.

Figure 2:
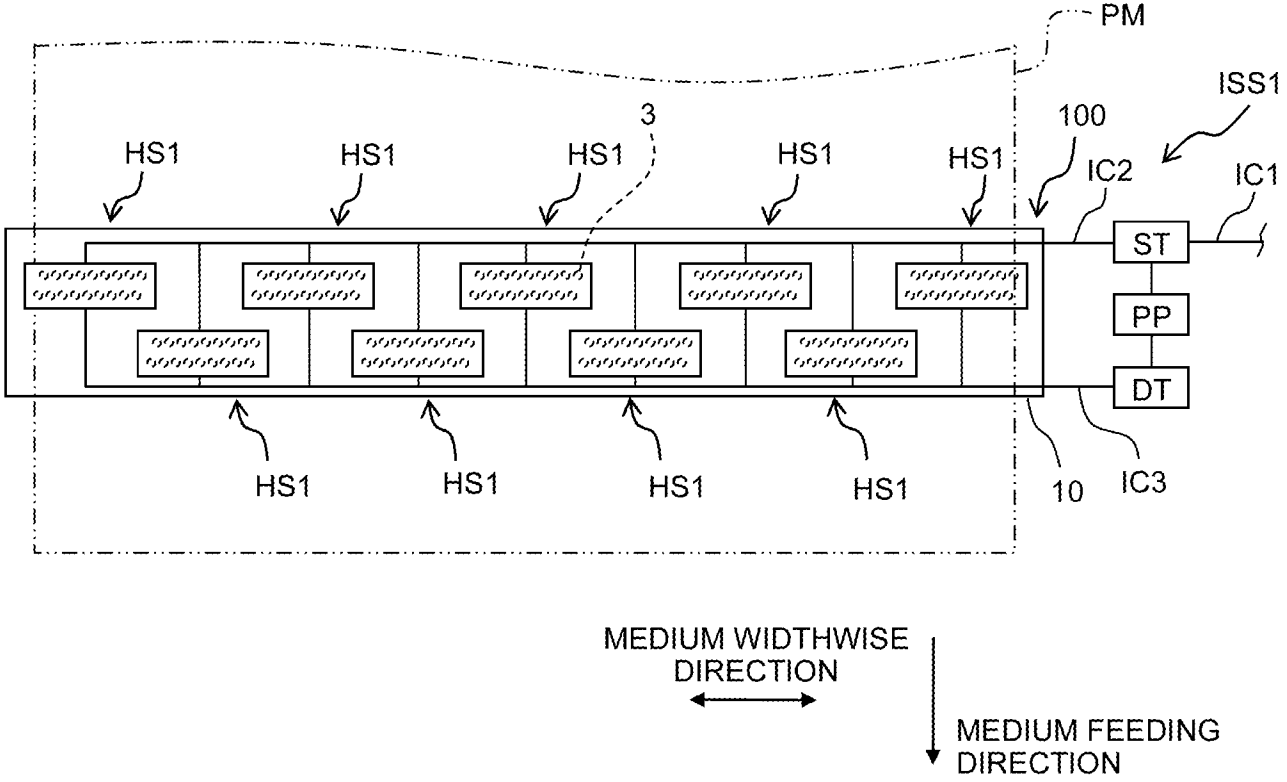
FIG. 2 is a plan view depicting a schematic structure of a head unit.

As depicted in FIG. 2, each of the four subtanks ST is connected via the ink channel member IC2 to the head systems HS1 (details will be described later on) included in the head unit 100 so that the ink is supplied to the corresponding head unit 100. Each of the four drain tanks DT is connected via the ink channel member IC3 to the head systems HS1 of the head unit 100 so that the ink is discharged from the corresponding head unit 100. A pump (differential pressure mechanism) PP is provided between the subtank ST and the drain tank DT. An ink supply system ISS1 of the first embodiment is configured by the head system HS1 and the subtank ST, the drain tank DT, and the pump PP connected thereto.

The controller CONT controls the respective units provided for the printer 1000 as a whole to perform, for example, the image formation on the medium PM. The controller CONT is provided with, for example, FPGA (Field Programmable Gate Array), EEPROM (Electrically Erasable Programmable Read-Only Memory), and RAM (Random Access Memory). Note that the controller CONT may be provided with, for example, CPU (Central Processing Unit) or ASIC (Application Specific Integrated Circuit). The controller CONT is connected to an external apparatus or device such as PC or the like (not depicted) so that the data communication can be performed. The controller CONT controls the respective units or components of the printer 1000 on the basis of the printing data fed from the external apparatus or device.

<Head Unit 100>

As depicted in FIG. 2, the head unit 100 is provided with a holding member 10 and nine head systems HS1 which are integrally supported by the holding member 10.

The holding member 10 is a plate-shaped member having a rectangular shape in a plan view in which the medium widthwise direction is the longitudinal direction (long side direction) and the medium feeding direction is the transverse direction (short side direction). The both end portions of the holding member 10 in the longitudinal direction are the portions subjected to the support, the portions being supported by the support member 100*a*.

The nine head systems HS1 are arranged at the inside of a plurality of openings (not depicted) of the holding member 10 respectively, and thus the nine head systems HS1 are integrally held or retained by the holding member 10. The nine head systems HS1 are arranged in a zigzag form in the medium widthwise direction in a plan view. Each of the head systems HS1 has a plurality of nozzles 3 at the lowermost portion thereof (details will be described later on).

<Head System HS1>

Figure 3:
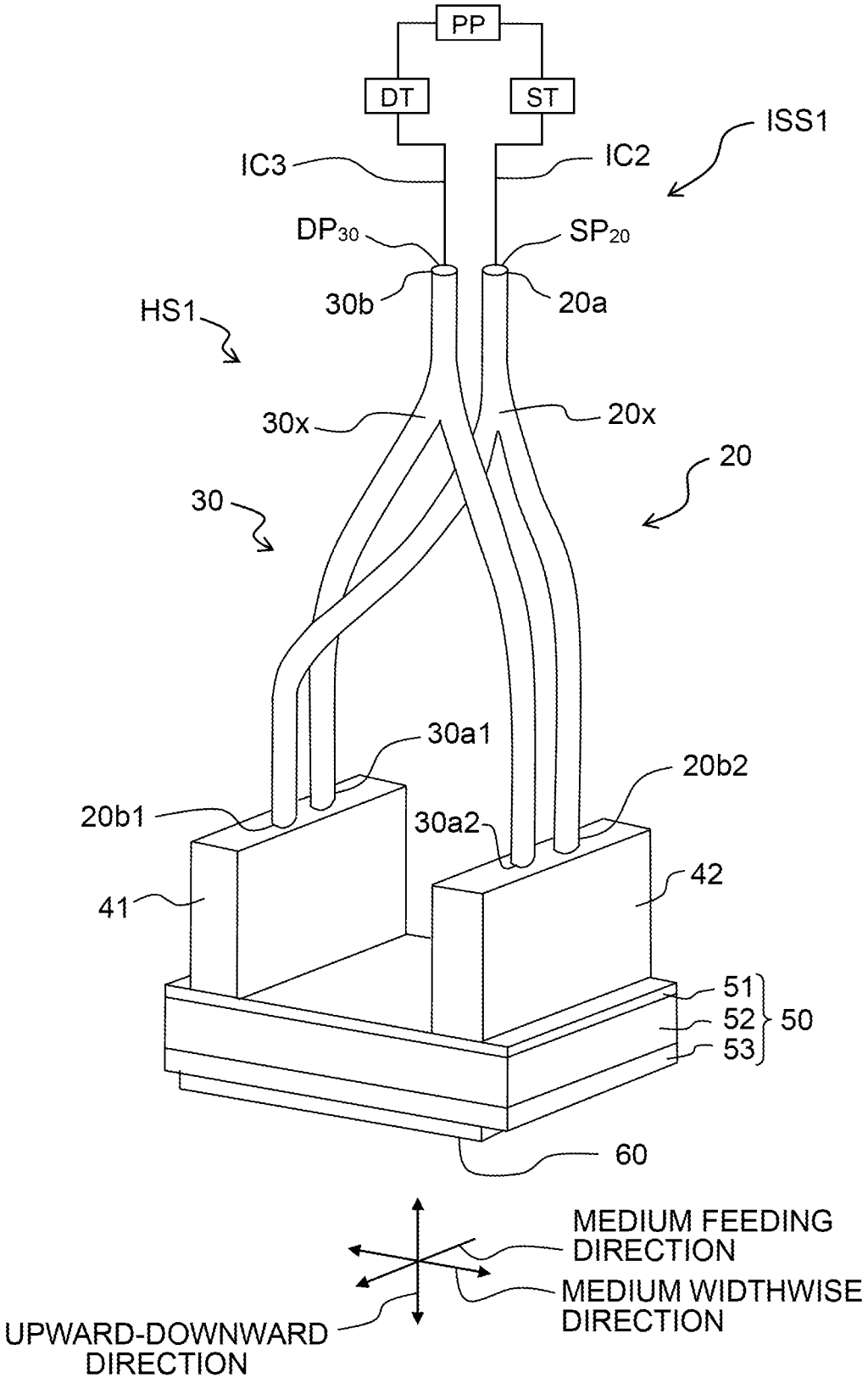
FIG. 3 is a perspective view depicting a head system according to a first embodiment of the present disclosure.
Figure 4:
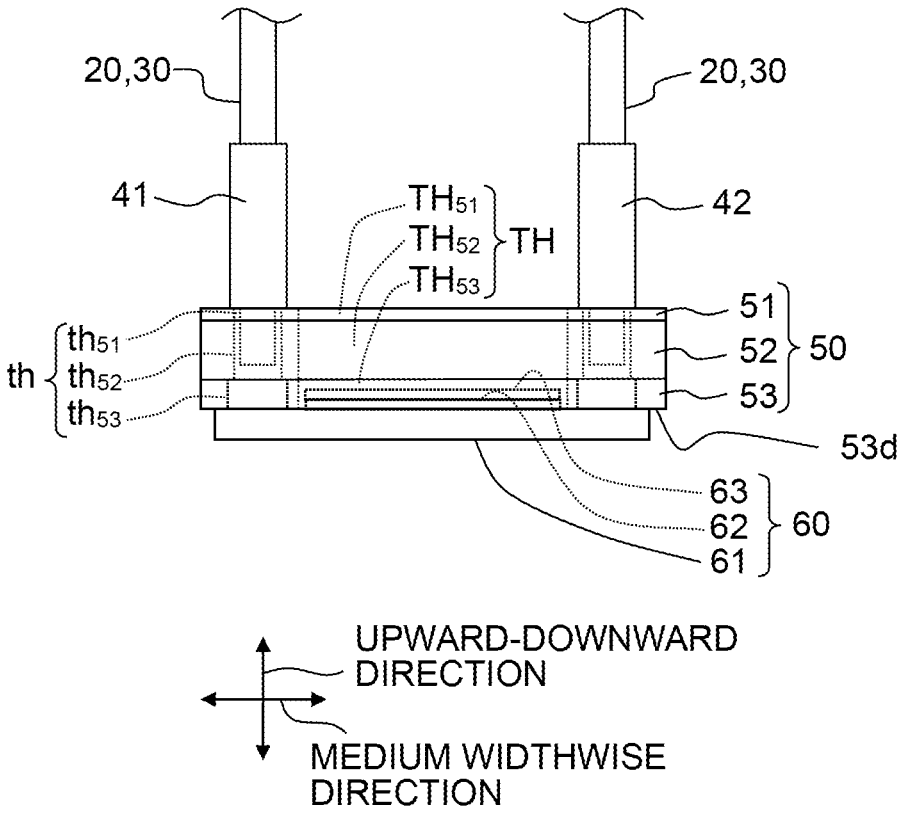
FIG. 4 is a side view depicting the positional relationship among an ink supply tube, an ink discharge tube, first and second channel blocks, a frame member, and a head.

As depicted in FIGS. 3 and 4, each of the plurality of head systems HS1 principally has an ink supply tube 20, an ink discharge tube 30, a first channel block 41, a second channel block 42, a frame member 50, and a head 60.

<Ink Supply Tube 20>

The ink supply tube 20 forms a part of the supply channel S (FIG. 9) for allowing the ink contained in the subtank ST to flow to the head 60. The ink supply tube 20 is a branched tube having one upstream end 20*a*, a junction (branch portion) 20*x*, and two downstream ends 20*b*1, 20*b*2. The upstream end 20*a* is arranged over or above the downstream ends 20*b*1, 20*b*2.

The ink supply tube 20 has an ink supply port $SP_{20}$ disposed at the upstream end 20*a*. The ink channel member IC2, which has an upstream end connected to the subtank ST, has a downstream end which is connected to the ink supply port $SP_{20}$.

<Ink Discharge Tube 30>

The ink discharge tube 30 forms a part of the discharge channel D (FIG. 9) for allowing the ink contained in the head 60 to flow to the drain tank DT. The ink discharge tube 30 is a branched tube having two upstream ends 30*a*1, 30*a*2, a junction (branch portion) 30*x*, and one downstream end 30*b*. The downstream end 30*b* is arranged over or above the upstream ends 30*a*1, 30*a*2.

The ink discharge tube 30 has an ink discharge port $DP_{30}$ disposed at the downstream end 30*b*. The ink channel member IC3, which has a downstream end connected to the drain tank DT, has an upstream end which is connected to the ink discharge port $DP_{30}$.

<First and Second Channel Blocks 41, 42>

The first and second channel blocks (first and second channel members) 41, 42 form a part of the supply channel S for allowing the ink contained in the subtank ST to flow to the head 60 and a part of the discharge channel D for allowing the ink contained in the head 60 to flow to the drain tank DT. The first and second channel blocks 41, 42 are arranged on the downstream side of the ink supply tube 20 and on the upstream side of the ink discharge tube 30.

The first and second channel blocks 41, 42 have structures identical to each other. Therefore, the first channel block 41 will be explained in this section.

Figure 5A:
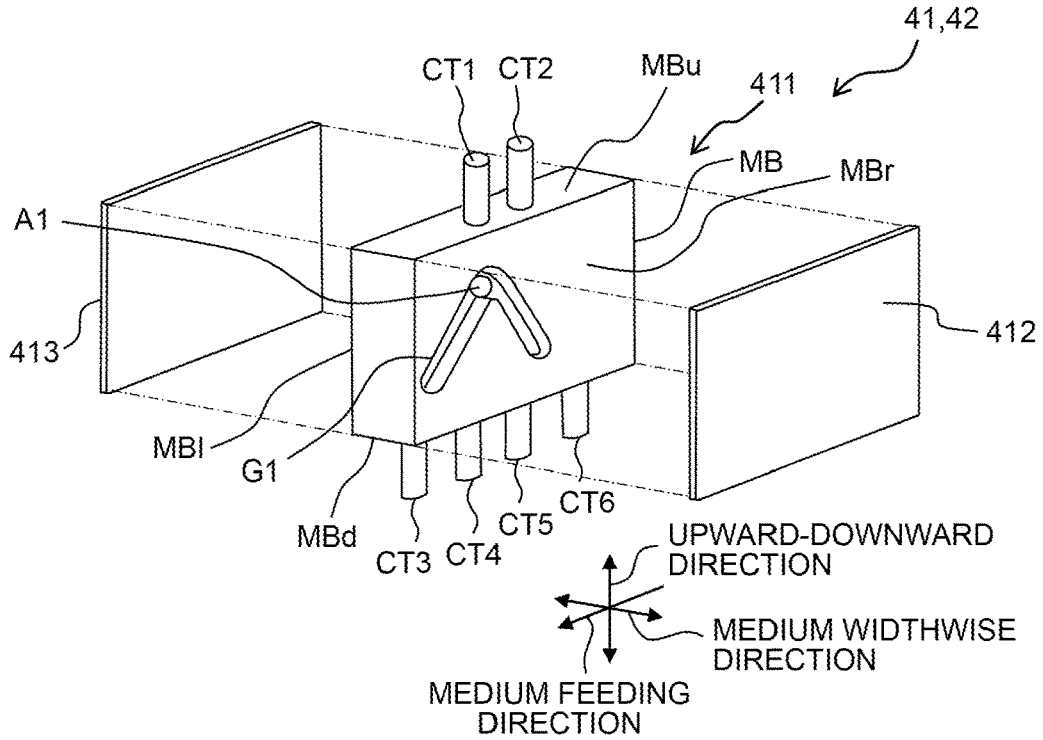
FIG. 5A is an exploded perspective view depicting each of the first and second channel blocks.
Figure 5B:
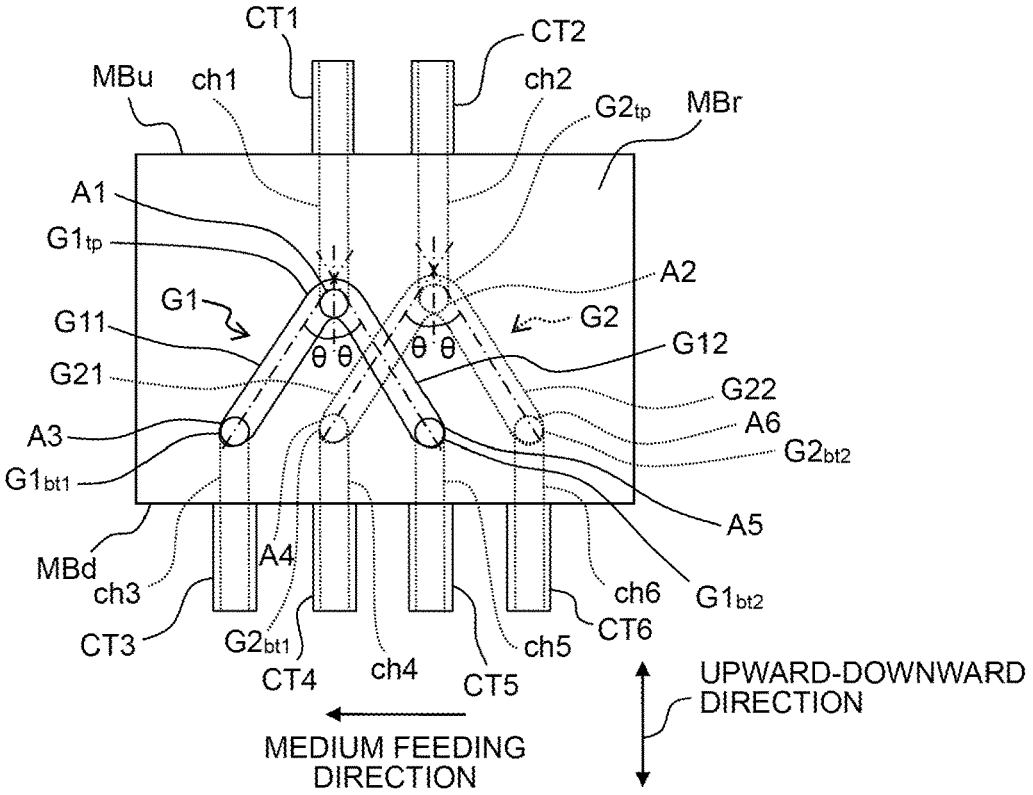
FIG. 5B is a side view depicting a channel forming unit of each of the first and second channel blocks.

As depicted in FIG. 5, the first channel block 41 principally has a channel forming unit 411 and a pair of covers 412, 413 which are attached to the channel forming unit 411.

The channel forming unit 411 has a main body portion MB which has a rectangular parallelepiped shape, two connecting tubes CT1, CT2 which protrude upwardly from the upper surface MBu of the main body portion MB, and four connecting tubes CT3, CT4, CT5, CT6 which protrude downwardly from the lower surface MBd of the main body portion MB.

The connecting tube CT1 is positioned on the discharge side as compared with the center in the medium feeding direction of the upper surface MBu, and the connecting tube CT2 is positioned on the supply side as compared with the center in the medium feeding direction of the upper surface MBu. Four connecting tubes CT3, CT4, CT5, and CT6 are arranged in this order from the discharge side to the supply side of the medium feeding direction.

An inverted V-shaped recessed groove G1 is formed on a side surface MBr disposed on the right side in the medium widthwise direction of the main body portion MB. The recessed groove G1 includes a first portion G11 which extends from a top portion $G1_{tp}$ (FIG. 5B) downwardly to the discharge side in the medium feeding direction to arrive at a lower end portion $G1_{bt1}$, and a second portion G12 which extends from the top portion $G1_{tp}$ downwardly to the supply side in the medium feeding direction to arrive at a lower end portion $G1_{bt2}$. The top portion $G1_{tp}$ is positioned in an area disposed on the discharge side as compared with the center in the medium feeding direction of the side surface MBr.

An inverted V-shaped recessed groove G2 is formed on a side surface MB1 disposed on the left side in the medium widthwise direction of the main body portion MB. The recessed groove G2 has the same shape as that of the recessed groove G1 as viewed in the medium widthwise direction. Specifically, the recessed groove G2 includes a first portion G21 which extends from a top portion $G2_{tp}$ downwardly to the discharge side in the medium feeding direction to arrive at a lower end portion $G2_{bt1}$, and a second portion G22 which extends from the top portion $G2_{tp}$ downwardly to the supply side in the medium feeding direction to arrive at a lower end portion $G2_{bt2}$. The top portion $G2_{tp}$ is positioned in an area disposed on the supply side as compared with the center in the medium feeding direction of the side surface MB1. That is, the recessed groove G1 and the recessed groove G2 are formed at the positions at which the recessed groove G1 and the recessed groove G2 are shifted from each other in the medium feeding direction.

The extending direction of the first portion G11, G21 and the extending direction of the second portion G12, G22 are inclined by an angle θ with respect to the upward-downward direction (vertical direction) so that the first portion G11, G21 and the second portion G12, G22 approach to one another at more upward positions. The angle θ is about 45° in this embodiment. However, the angle θ may be set to any arbitrary angle less than 90°. When the channel is allowed to extend in any direction different from the vertical direction, then the extending direction of the channel may be allowed to differ from the horizontal direction as described above, and thus it is possible to suppress the precipitation of the pigment onto the bottom surface of the channel. Further, any bubble mixed into the ink can be suppressed from staying at the upper surface of the channel, and it is possible to allow the bubble to flow upwardly more reliably.

Channels ch1, ch3, ch5, which extend in the upward-downward direction, are formed respectively at positions overlapped with the top portion $G1_{tp}$, the lower end portion $G1_{bt1}$, and the lower end portion $G1_{bt2}$ in the medium feeding direction at the inside of the main body portion MB. Further, channels ch2, ch4, ch6, which extend in the upward-downward direction, are formed respectively at positions overlapped with the top portion $G2_{tp}$, the lower end portion $G2_{bt1}$, and the lower end portion $G2_{bt2}$ in the medium feeding direction.

The lower end portion of the channel ch1 is communicated with the recessed groove G1 via an opening A1 formed at the top portion $G1_{tp}$ of the recessed groove G1, and the upper end portion of the channel ch1 is communicated with the connecting tube CT1 disposed on the upper surface MBu of the main body portion MB. The upper end portion of the channel ch3 is communicated with the recessed groove G1 via an opening A3 formed at the lower end portion $G1_{bt1}$ of the recessed groove G1, and the lower end portion of the channel ch3 is communicated with the connecting tube CT3 disposed on the lower surface MBd of the main body portion MB. The upper end portion of the channel ch5 is communicated with the recessed groove G1 via an opening A5 formed at the lower end portion $G1_{bt2}$ of the recessed groove G1, and the lower end portion of the channel ch5 is communicated with the connecting tube CT5 disposed on the lower surface MBd of the main body portion MB.

The lower end portion of the channel ch2 is communicated with the recessed groove G2 via an opening A2 formed at the top portion $G2_{tp}$ of the recessed groove G2, and the upper end portion of the channel ch2 is communicated with the connecting tube CT2 disposed on the upper surface MBu of the main body portion MB. The upper end portion of the channel ch4 is communicated with the recessed groove G2 via an opening A4 formed at the lower end portion $G2_{bt1}$ of the recessed groove G2, and the lower end portion of the channel ch4 is communicated with the connecting tube CT4 disposed on the lower surface MBd of the main body portion MB. The upper end portion of the channel ch6 is communicated with the recessed groove G2 via an opening A6 formed at the lower end portion $G2_{bt2}$ of the recessed groove G2, and the lower end portion of the channel ch6 is communicated with the connecting tube CT6 disposed on the lower surface MBd of the main body portion MB.

The covers 412, 413 are members which are provided to cover the recessed grooves G1, G2 of the main body portion MB. The covers 412, 413 are flat plates, which have shapes and dimensions as viewed in the medium widthwise direction that are the substantially the same as those of the main body portion MB. The covers 412, 413 are attached to the side surfaces MBr, MB1 of the main body portion MB by means of arbitrary fastener such as screws or the like respectively to cover the recessed grooves G1, G2 therewith. In order to hermetically seal the recessed grooves G1, G2 more reliably, O-rings, which extend along the contours of the recessed grooves G1, G2, may be provided between the main body portion MB and the covers 412, 413.

The recessed groove G1 of the main body portion MB is covered with the cover 412, and thus a branched channel, which is configured by the connecting tubes CT1, CT3, CT5, the channels ch1, ch3, ch5, and the recessed groove G1, is formed at the inside of the first channel block 41. Further, the recessed groove G2 of the main body portion MB is covered with the cover 413, and thus a branched channel, which is configured by the connecting tubes CT2, CT4, CT6, the channels ch2, ch4, ch6, and the recessed groove G2, is formed.

The downstream end 20*b*1 of the ink supply tube 20 is connected to the connecting tube CT1 of the first channel block 41, and the upstream end 30*a*1 of the ink discharge tube 30 is connected to the connecting tube CT2 of the first channel block 41. The upstream end 30*a*2 of the ink discharge tube 30 is connected to the connecting tube CT1 of the second channel block 42, and the downstream end 20*b*2 of the ink supply tube 20 is connected to the connecting tube CT2 of the second channel block 42.

<Frame Member 50>

The frame member 50 is a structure for connecting the first and second channel blocks 41, 42 to the head 60 and fix these components to the support plate 10. The frame member 50 is arranged under or below the first and second channel members 41, 42.

Figure 6:
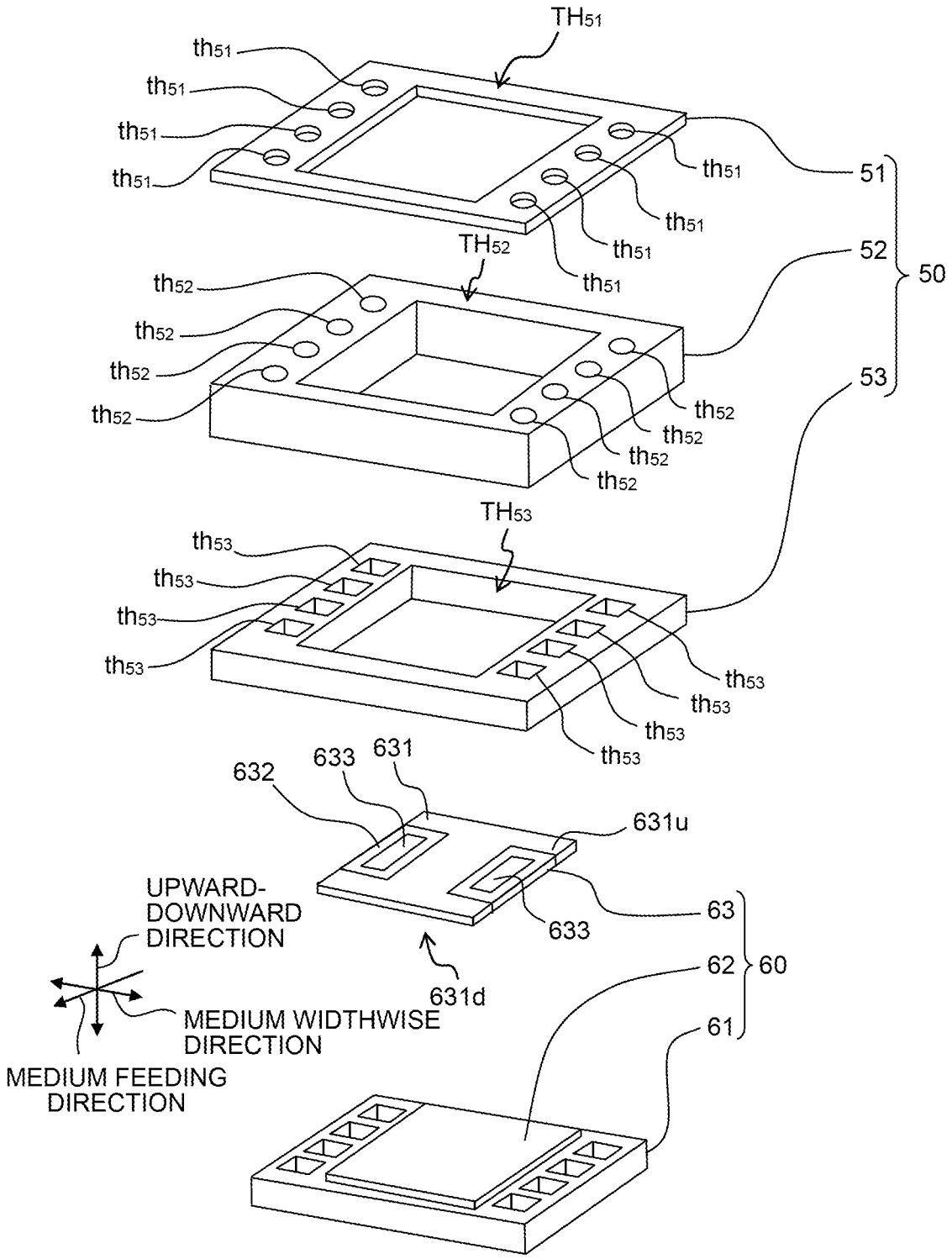
FIG. 6 is an exploded perspective view depicting the frame member and the head.

As depicted in FIGS. 3 and 6, the frame member 50 is a stacked structure including an alignment frame 51, a back end frame 52, and a front end frame 53 which are stacked in this order from the top.

The alignment frame 51 is, for example, a flat plate member made of SUS. The alignment frame 51 has a central through-hole $TH_{51}$ which vertically penetrates through the central portion of the alignment frame 51 and which is rectangular in a plan view, and eight channel-forming through-holes $th_{51}$ which are provided around the central through-hole $TH_{51}$ and which are circular in a plan view. Four channel-forming through-holes $th_{51}$ are provided while being aligned in the medium feeding direction on each of the both sides in the medium widthwise direction of the central through-hole $TH_{51}$.

The back end frame 52 is, for example, a rectangular parallelepiped member which is made of resin. The back end frame 52 has a central through-hole $TH_{52}$ which vertically penetrates through the central portion of the back end frame 52 and which is rectangular in a plan view, and eight channel-forming through-holes $th_{52}$ which are provided around the central through-hole $TH_{52}$ and which are circular in a plan view. Four channel-forming through-holes $th_{52}$ are provided while being aligned in the medium feeding direction on each of the both sides in the medium widthwise direction of the central through-hole $TH_{52}$.

The front end frame 53 is, for example, a flat plate member made of SUS. The front end frame 53 has a central through-hole $TH_{53}$ which vertically penetrates through the central portion of the front end frame 53 and which is rectangular in a plan view, and eight channel-forming through-holes $th_{53}$ which are provided around the central through-hole $TH_{53}$ and which are substantially rectangular in a plan view. Four channel-forming through-holes $th_{53}$ are provided while being aligned in the medium feeding direction on each of the both sides in the medium widthwise direction of the central through-hole $TH_{53}$.

The central through-hole $TH_{51}$ of the alignment frame 51, the central through-hole $TH_{52}$ of the back end frame 52, and the central through-hole $TH_{53}$ of the front end frame 53 are communicated with each other to form a central through-hole TH in a state in which the alignment frame 51, the back end frame 52, and the front end frame 53 are stacked in this order from the top (FIG. 4). Further, the respective eight channel-forming through-holes $th_{51}$ of the alignment frame 51, the respective eight channel-forming through-holes $th_{52}$ of the back end frame 52, and the respective eight channel-forming through-holes $th_{53}$ of the front end frame 53 are communicated with each other to form eight channel-forming through-holes th (FIG. 4).

The frame member 50 is fixed to the support plate 10 by the aid of the alignment frame 51.

The connecting tubes CT3 to CT6 of the first channel block 41 are inserted into the four channel-forming through-holes th formed on the left side in the medium widthwise direction of the central through-hole TH. The connecting tubes CT3 to CT6 of the second channel block 42 are inserted into the four channel-forming through-holes th formed on the right side in the medium widthwise direction of the central through-hole TH. O-rings (not depicted) may be arranged between the inner circumferential surfaces of the channel-forming through-holes th and the outer circumferential surfaces of the connecting tubes CT3 to CT6.

<Head 60>

Figure 7:
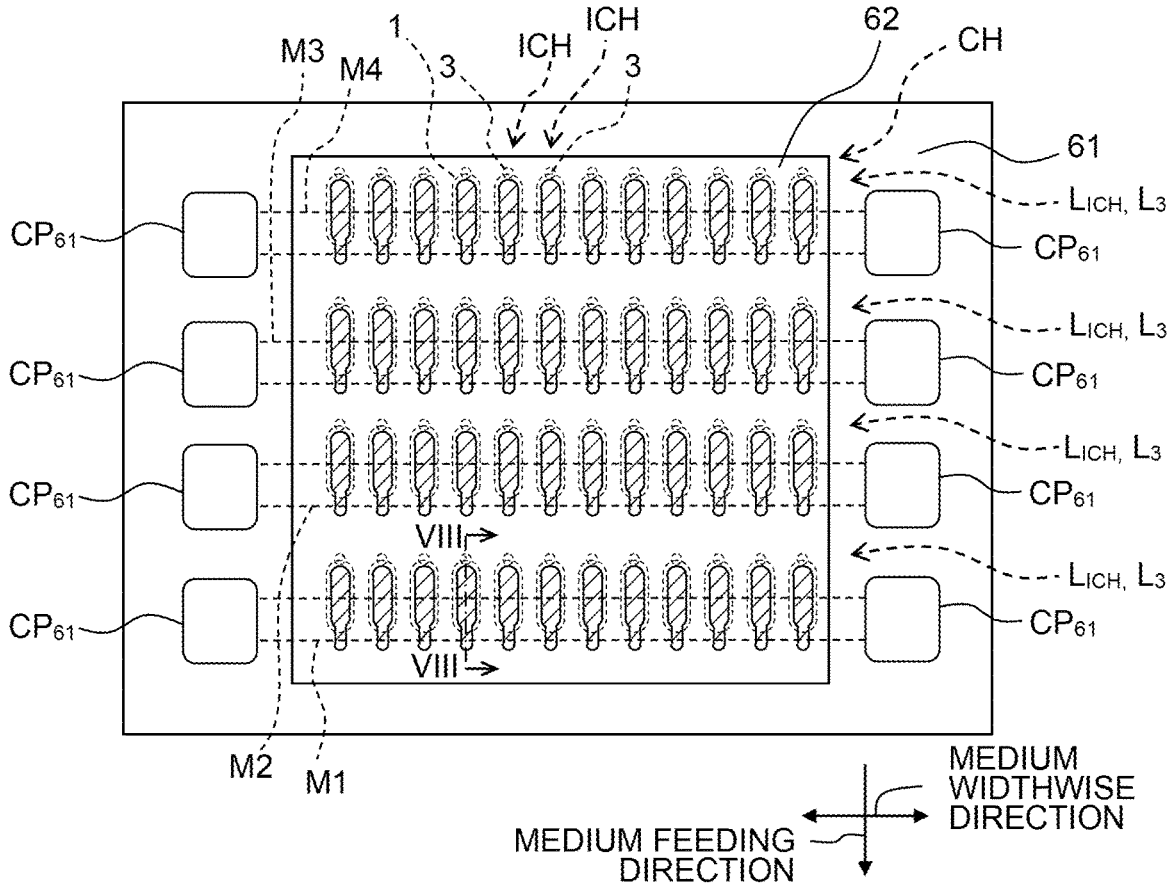
FIG. 7 is a plan view depicting a channel unit and an actuator.
Figure 8:
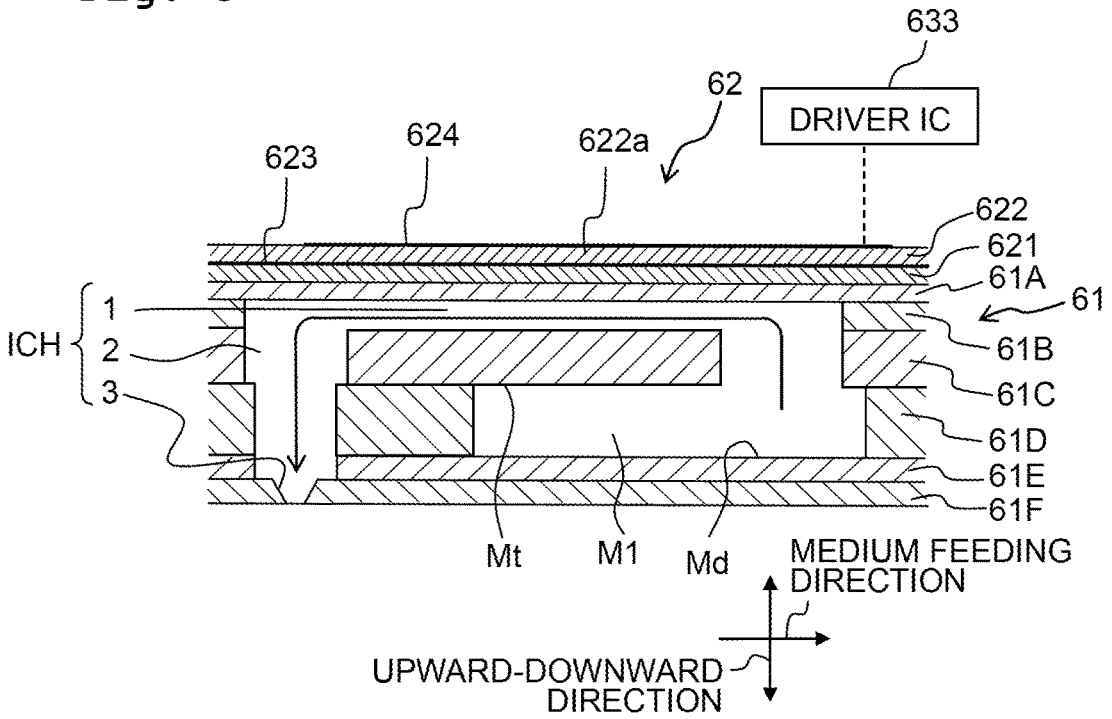
FIG. 8 is a sectional view taken along a line VIII-VIII depicted in FIG. 7.

As depicted in FIGS. 6, 7, and 8, the head 60 is provided with a channel unit 61, a piezoelectric actuator 62, and an ejection controller (an ejection control unit) 63.

As depicted in FIG. 8, the channel unit 61 is a stacked structure including an ink sealing film 61A, plates 61B to 61E, and a nozzle plate 61F which are stacked in this order from the top. A channel CH (FIG. 7) are formed at the inside of the channel unit 61 by removing a part of each of the plates 61B to 61E and the nozzle plate 61F.

As depicted in FIGS. 7 and 8, the channel CH includes eight ink flow ports $CP_{61}$, four manifolds (manifold channels) M1, M2, M3, M4, and forty-eight individual channels ICH.

As for the eight ink flow ports $CP_{61}$, four ink flow ports $CP_{61}$ are provided while being aligned in the medium feeding direction at each of the both end portions in the medium widthwise direction of the channel unit 61. The respective eight ink flow ports $CP_{61}$ are formed by coaxially providing through-holes through the ink sealing film 61A and the plates 61B, 61C respectively.

Each of four manifolds M1 to M4 is linear or straight channel which extends in the medium widthwise direction. That is, the four channels M1 to M4 extend in parallel to one another. The four manifolds M1 to M4 are provided in this order in the medium feeding direction from the discharge side to the supply side.

Each of four manifolds M1 to M4 is formed by removing a part of the plate 61D. That is, the four manifolds M1 to M4 are formed at identical positions in the upward-downward direction. The upper surfaces Mt of the four manifolds M1 to M4 are flush with each other, and the bottom surfaces Md of the four manifolds M1 to M4 are flush with each other.

The manifolds M1 to M4 are communicated with the ink flow ports $CP_{61}$ respectively at the both end portions in the medium widthwise direction.

As depicted in FIG. 8, each of the forty-eight individual channels ICH includes a pressure chamber 1, a descender channel 2, and a nozzle 3.

The pressure chamber 1 is the space which is provided to apply the pressure brought about by the piezoelectric actuator 62 to the ink, and the pressure chamber 1 is formed by removing a part of the plate 61B. The upper surface of the pressure chamber 1 is formed by the ink sealing film 61A. The shape of the pressure chamber 1 in a plan view is an elliptical shape which is long in the medium feeding direction (FIG. 7). A channel, which extends to the manifold M1 (or any one of the manifolds M2 to M4), is connected to the vicinity of one circular arc portion, and the descender channels 2 is connected to the vicinity of the other circular arc portion.

The descender channel 2 is the channel for allowing the ink contained in the pressure chamber 1 to flow to the nozzle 3. The descender channel 2 is formed by coaxially providing circular through-holes through the plates 61C to 61E respectively. The descender channel 2 extends in the upward-downward direction from the pressure chamber 1 to the nozzle 3.

The nozzle 3 is the minute opening for discharging the ink toward the medium PM. The nozzle 3 is formed through the nozzle plate 61F.

Twelve individual channels ICH are connected to each of the four manifolds M1 to M4. An individual channel array $L_{ICH}$ is formed by the twelve individual channels ICH which are connected to one manifold such that the twelve individual channels ICH are aligned in the medium widthwise direction. Further, a nozzle array $L_3$ is formed by twelve nozzles 3 of the twelve individual channels ICH forming one individual channel array $L_{ICH}$. The pressure chambers 1 of the plurality of individual channels ICH included in each of the individual channel arrays $L_{ICH}$ are connected to only the corresponding manifold, and they are not connected to any other manifold. Therefore, only the ink, which passes through the corresponding manifold, is supplied to the pressure chambers 1 of the plurality of individual channels ICH included in each of the individual channel arrays $L_{ICH}$. In this embodiment, the respective nozzles 3, which are provided for a predetermined nozzle array $L_3$, are provided at positions deviated slightly in the medium widthwise direction as compared with the respective nozzles 3 which are provided for another nozzle array $L_3$ adjacent to the predetermined nozzle array $L_3$.

As depicted in FIG. 8, the piezoelectric actuator 62 is configured by a first piezoelectric layer 621 which is provided on the upper surface of the channel unit 61, a second piezoelectric layer 622 which is provided over or above the first piezoelectric layer 621, a common electrode 623 which is interposed between the first piezoelectric layer 621 and the second piezoelectric layer 622, and a plurality of individual electrodes 624 which are provided on the upper surface of the second piezoelectric layer 622.

The first piezoelectric layer 621 is provided on the upper surface of the ink sealing film 61A so that all of the plurality of individual channels ICH formed in the channel unit 61 are covered therewith. The common electrode 623 is provided on the upper surface of the first piezoelectric layer 621 while covering the substantially entire region of the upper surface of the first piezoelectric layer 621. The second piezoelectric layer 622 is provided on the upper surface of the common electrode 623 while covering the entire regions of the first piezoelectric layer 621 and the common electrode 623.

The common electrode 623 is grounded via a wiring (not depicted), and the common electrode 623 is always retained at the ground electric potential.

Each of the plurality of individual electrodes 624 has a substantially rectangular planar shape in which the medium feeding direction is the longitudinal direction. The plurality of individual electrodes 624 are provided on the upper surface of the second piezoelectric layer 622 so that the plurality of individual electrodes 624 are positioned over or above the pressure chambers 1 of the plurality of individual channels ICH respectively. Each of the plurality of individual electrodes 624 is aligned so that each of the plurality of individual electrodes 624 is positioned over or above the central portion of the corresponding pressure chamber 1.

In the structure in which the first piezoelectric layer 621, the second piezoelectric layer 622, the common electrode 623, and the plurality of individual electrodes 624 are arranged as described above, the portion of the second piezoelectric layer 622, which is interposed between the common electrode 623 and each of the plurality of individual electrodes 624, serves as an active portion 622*a* which is polarized in the thickness direction.

As depicted in FIG. 6, the ejection controller 63 is provided with a holding plate 631, FPC (Flexible Printed Circuits) 632 which is wound around the holding plate 631, and two driver ICs 633 which are mounted on FPC 632.

A plurality of contacts (not depicted) are formed at a portion of FPC 632 positioned on the side of the lower surface 631*d* of the holding plate 631. Two driver ICs 633 are mounted at portions of FPC 632 positioned on the side of the upper surface 631*u* of the holding plate 631.

The ejection controller 63 is arranged on the upper surface of the piezoelectric actuator 62 so that each of the plurality of contacts of FPC 632 is electrically connected to each of the plurality of individual electrodes 624 of the piezoelectric actuator 62. Accordingly, each of the plurality of individual electrodes 624 of the piezoelectric actuator 62 is connected to the driver IC 633 via FPC 632. Specifically, the driver IC 633, which is arranged on the right side in the medium widthwise direction, is connected to the individual electrodes 624 which are positioned on the right side as compared with the center in the medium widthwise direction, and the driver IC 633, which is arranged on the left side in the medium widthwise direction, is connected to the individual electrodes 624 which are positioned on the left side as compared with the center in the medium widthwise direction. Further, the driver ICs 633 are connected to the controller CONT via undepicted wirings.

The head 60 is fixed to the lower surface 53*d* (FIG. 4) of the front end frame 53 of the frame member 50. In this state, the eight ink flow ports $CP_{61}$ are communicated with the eight channel-forming through-holes th respectively. Further, the piezoelectric actuator 62 and the ejection controller 63 are arranged at the inside of the central through-hole TH.

<Channel Structure of Ink Supply System ISS1>

The channels, which are formed by the ink supply system ISS1 including the head system HS1 having the configuration as described above, will be organized with reference to FIG. 9.

The supply channel S, which is provided to feed the ink contained in the subtank ST to the head 60, is formed by the ink supply tube 20, the channels which extend from the connecting tube CT1 of the first channel block 41 to the connecting tubes CT3, CT5, the channels which extend from the connecting tube CT2 of the second channel block 42 to the connecting tubes CT4, CT6, and the channel-forming through-holes th of the frame member 50.

The ink, which is supplied from the subtank ST via the ink channel member IC2 to the ink supply port $SP_{20}$ disposed at the upstream end 20*a* of the ink supply tube 20, flows through the ink supply tube 20 until arrival at the junction (branch point) 20*x*, and then the ink is divided into two flows. One flow flows toward the downstream end 20*b*1 of the ink supply tube 20 and the first channel block 41, and the other flow flows toward the downstream end 20*b*2 of the ink supply tube 20 and the second channel block 42.

The ink, which has flown toward the first channel block 41, passes through the connecting tube CT1 connected to the downstream end 20*b*1 of the ink supply tube 20, and the ink arrives at the recessed groove G1. The ink is divided into two flows at the top portion $G1_{tp}$ of the recessed groove G1.

One flow of the ink after being divided into the two flows passes through the first portion G11 of the recessed groove G1, the channel ch3, the connecting tube CT3, channel-forming through-hole th of the frame member 50, and the ink flow port $CP_{61}$ of the head 60 disposed on the left side in the medium widthwise direction and at the first position as counted from the discharge side end portion in the medium feeding direction, and the flow of the ink flows into the manifold M1. The other flow of the ink after being divided into the two flows passes through the second portion G12 of the recessed groove G1, the channel ch5, the connecting tube CT5, the channel-forming through-hole th of the frame member 50, and the ink flow port $CP_{61}$ of the head 60 disposed on the left side in the medium widthwise direction at the third position as counted from the discharge side end portion in the medium feeding direction, and the flow of the ink flows into the manifold M3.

The ink, which has flown toward the second channel block 42, passes through the connecting tube CT2 connected to the downstream end 20*b*2 of the ink supply tube 20, and the ink arrives at the recessed groove G2. The ink is divided into two ink flows at the top portion $G2_{tp}$ of the recessed groove G2.

One flow of the ink after being divided into the two flows passes through the first portion G21 of the recessed groove G2, the channel ch4, the connecting tube CT4, channel-forming through-hole th of the frame member 50, and the ink flow port $CP_{61}$ of the head 60 disposed on the right side in the medium widthwise direction at the second position as counted from the discharge side end portion in the medium feeding direction, and the flow of the ink flows into the manifold M2. The other flow of the ink after being divided into the two flows passes through the second portion G22 of the recessed groove G2, the channel ch6, the connecting tube CT6, the channel-forming through-hole th of the frame member 50, and the ink flow port $CP_{61}$ of the head 60 disposed on the right side in the medium widthwise direction at the fourth position as counted from the discharge side end portion in the medium feeding direction, and the flow of the ink flows into the manifold M4.

The discharge channel D, which is provided to feed (send) the ink contained in the head 60 to the drain tank DT, is formed by the ink discharge tube 30, the channels which extend from the connecting tube CT2 of the first channel block 41 to the connecting tubes CT4, CT6, the channels which extend from the connecting tube CT1 of the second channel block 42 to the connecting tubes CT3, CT5, and the channel-forming through-holes th of the frame member 50.

The ink, which passes through the manifold M1 and arrives at the ink flow port $CP_{61}$ positioned on the right side in the medium widthwise direction at the first position as counted from the discharge side end portion in the medium feeding direction, passes through the channel-forming through-hole th of the frame member 50, and the ink flows into the second channel block 42 from the connecting tube CT3 of the second channel block 42. The ink, which passes through the manifold M3 and arrives at the ink flow port $CP_{61}$ positioned on the right side in the medium widthwise direction at the third position as counted from the discharge side end portion in the medium feeding direction, passes through the channel-forming through-hole th of the frame member 50, and the ink flows into the second channel block 42 from the connecting tube CT5 of the second channel block 42. The flows of the ink as described above merge at the top portion $G1_{tp}$ of the recessed groove G1 of the second channel block 42. The ink passes through the connecting tube CT1 of the second channel block 42 and the ink discharge tube 30, and the ink is fed to the drain tank DT from the ink discharge port $DP_{30}$.

The ink, which passes through the manifold M2 and arrives at the ink flow port $CP_{61}$ positioned on the left side in the medium widthwise direction at the second position as counted from the discharge side end portion in the medium feeding direction, passes through the channel-forming through-hole th of the frame member 50, and the ink flows into the first channel block 41 from the connecting tube CT4 of the first channel block 41. The ink, which passes through the manifold M4 and arrives at the ink flow port $CP_{61}$ positioned on the left side in the medium widthwise direction at the fourth position as counted from the discharge side end portion in the medium feeding direction, passes through the channel-forming through-hole th of the frame member 50, and the ink flows into the first channel block 41 from the connecting tube CT6 of the first channel block 41. The flows of the ink as described above merge at the top portion $G2_{tp}$ of the recessed groove G2 of the first channel block 41. The ink passes through the connecting tube CT2 of the first channel block 41 and the ink discharge tube 30, and the ink is fed to the drain tank DT from the ink discharge port $DP_{30}$.

Figure 9:
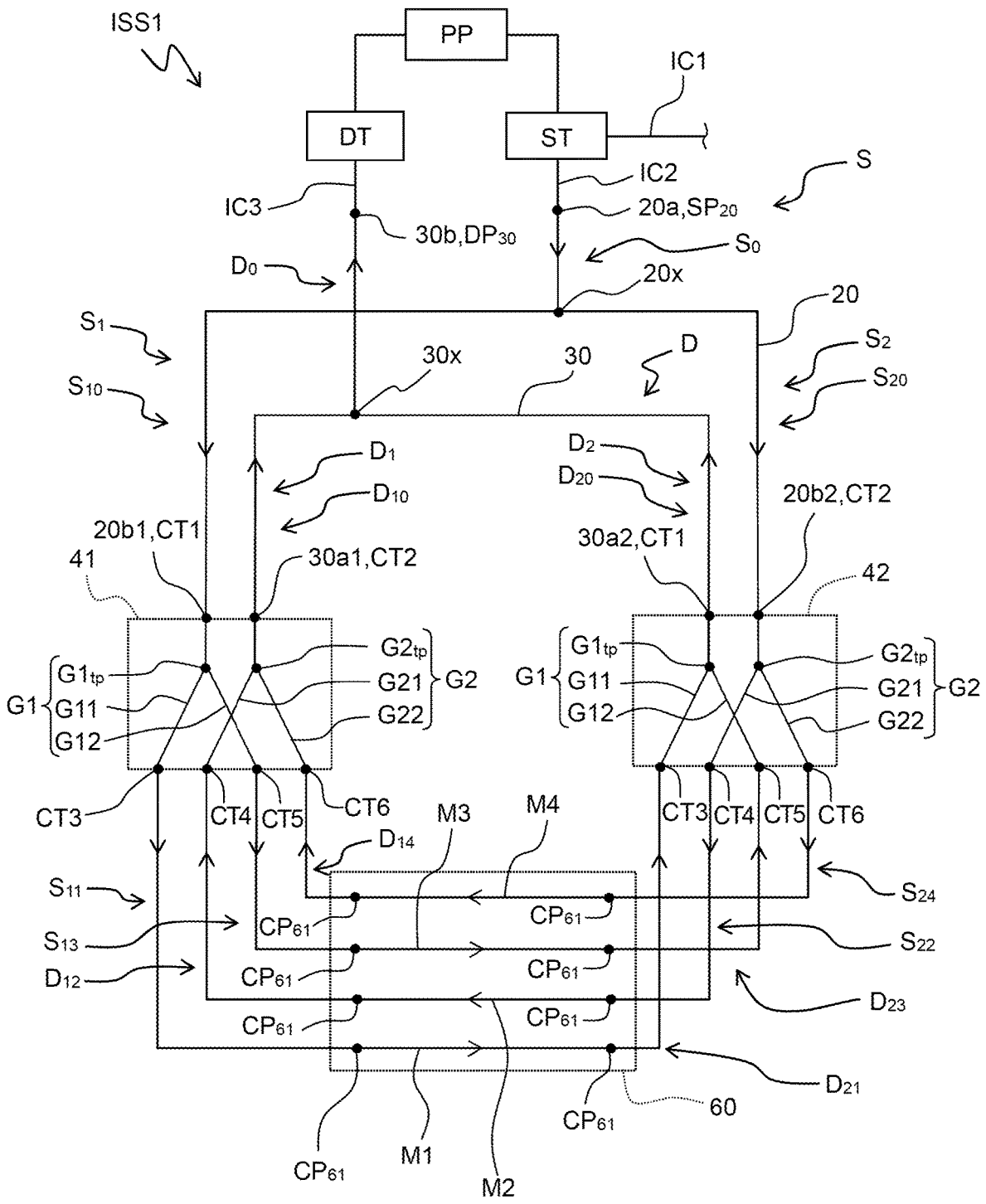
FIG. 9 is an explanatory drawing depicting channels formed by an ink supply system according to the first embodiment of the present disclosure.

The directions, in which the ink flows through the supply channel S, the manifolds M1 to M4, and the discharge channel D, are as indicated by the arrows in FIG. 9. As depicted in FIG. 9, as for the ink supply system ISS1 including the head system HS1 of this embodiment, the ink flows toward the right side in the medium widthwise direction in the manifolds M1, M3, and the ink flows toward the left side in the medium widthwise direction in the manifolds M2, M4. That is, the ink is caused to flow in the mutually opposite directions through the two manifolds which are adjacent to one another without allowing any other manifold to be intervened therebetween in the medium feeding direction (without any interposed manifold). The reason, why the ink is caused to flow as described above, will be described later on.

In this case, the channel, which is formed (defined) between the upstream end 20*a* of the ink supply tube 20 and the junction 20*x*, is the common supply channel $S_0$. The channel, which extends from the junction 20*x* of the ink supply tube 20 via the first channel block 41 to arrive at the head 60, is the first supply branched-channel $S_1$. The channel, which extends from the junction 20*x* of the ink supply tube 20 via the second channel block 42 to arrive at the head 60, is the second supply branched-channel $S_2$.

The ink supply tube 20 and the first and second channel blocks 41, 42 may be configured so that the channel resistance of the first supply branched-channel $S_1$ is the same as the channel resistance of the second supply branched-channel $S_2$. Specifically, for example, the ink supply tube 20 and the first and second channel blocks 41, 42 may be configured so that the channel length of the first supply branched-channel $S_1$ is the same as the channel length of the second supply branched-channel $S_2$, and the cross-sectional area (cross-sectional area based on the plane orthogonal to the direction in which the channel extends) of the first supply branched-channel $S_1$ is the same as the cross-sectional area of the second supply branched-channel $S_2$. Accordingly, the amounts of the ink fed from the junction 20*x* to the first and second supply branched-channels $S_1$, $S_2$ are equal to (identical to) one another (equal amount branching can be achieved), and it is possible to cause the ink to flow at a stable flow rate. Further, according to the above, the flow rate of the ink flowing through the manifolds M1, M3 is the same as the flow rate of the ink flowing through the manifolds M2, M4, and thus, any uneven temperature is more favorably dissolved for the ink flowing through the manifolds M1 to M4. Consequently, any uneven density (depth) is more favorably dissolved in the image formation (details will be described later on).

The channel included in the first supply branched-channel $S_1$, which is formed between the junction 20*x* of the ink supply tube 20 and the top portion $G1_{tp}$ of the recessed groove G1 of the first channel block 41, is the first common supply branched-channel $S_{10}$. The channels, which are formed between the top portion $G1_{tp}$ and the manifolds M1, M3, are the first and third branched supply branched-channels $S_{11}$, $S_{13}$, respectively. The channel included in the second supply branched-channel $S_2$, which is formed between the junction 20*x* of the ink supply tube 20 and the top portion $G2_{tp}$ of the recessed groove G2 of the second channel block 42, is the second common supply branched-channel $S_{20}$. The channels, which are formed between the top portion $G2_{tp}$ and the manifolds M2, M4, are the second and fourth branched supply branched-channels $S_{22}$, $S_{24}$, respectively. The recessed grooves G1, G2 of the first and second channel blocks 41, 42 may be configured so that the first portion G11 and the second portion G12, which extend in the directions different from the vertical direction while intersecting the plane (horizontal plane) including the medium widthwise direction and the medium feeding direction, have the channel lengths which are not less than halves of the channel lengths of the first, second, third, and fourth branched supply branched-channels $S_{11}$, $S_{22}$, $S_{13}$, $S_{24}$.

Further, the channel, which is formed between the downstream end 30*b* of the ink discharge tube 30 and the junction 30*x*, is the common discharge channel $D_0$. The channel, which extends from the junction 30*x* of the ink discharge tube 30 via the first channel block 41 to arrive at the head 60, is the first discharge branched-channel $D_1$. The channel, which extends from the junction 30*x* of the ink discharge tube 30 via the second channel block 42 to arrive at the head 60, is the second discharge branched-channel $D_2$.

The ink discharge tube 30 and the first and second channel blocks 41, 42 may be configured so that the channel resistance of the first discharge branched-channel $D_1$ is the same as the channel resistance of the second discharge branched-channel $D_2$. Specifically, for example, the ink discharge tube 30 and the first and second channel blocks 41, 42 may be configured so that the channel length of the first discharge branched-channel $D_1$ is the same as the channel length of the second discharge branched-channel $D_2$, and the cross-sectional area (cross-sectional area based on the plane orthogonal to the direction in which the channel extends) of the first discharge branched-channel $D_1$ is the same as the cross-sectional area of the second discharge branched-channel $D_2$. Accordingly, the amounts of the ink fed from the first and second discharge branched-channels $D_1$, $D_2$ to the junction 30*x* are equal to one another, and it is possible to flow the ink at a stable flow rate. Further, according to the above, the flow rate of the ink flowing through the manifolds M1, M3 is the same as the flow rate of the ink flowing through the manifolds M2, M4, and thus, any uneven temperature is more favorably dissolved for the ink flowing through the manifolds M1 to M4. Consequently, any uneven density (depth) is more favorably dissolved in the image formation (details will be described later on).

The channel included in the first discharge branched-channel $D_1$, which is formed between the junction 30*x* of the ink discharge tube 30 and the top portion $G2_{tp}$ of the recessed groove G2 of the first channel block 41, is the first common discharge branched-channel $D_{10}$. The channels, which are formed between the top portion $G2_{tp}$ and the manifolds M2, M4, are the second and fourth branched discharge branched-channels $D_{12}$, $D_{14}$, respectively. The channel included in the second discharge branched-channel $D_2$, which is formed between the junction 30*x* of the ink discharge tube 30 and the top portion $G1_{tp}$ of the recessed groove G1 of the second channel block 42, is the second common discharge branched-channel $D_{20}$. The channels, which are formed between the top portion $G1_{tp}$ and the manifolds M1, M3, are the first and third branched discharge branched-channels $D_{21}$, $D_{23}$, respectively. The recessed grooves G1, G2 of the first and second channel blocks 41, 42 may be configured so that the first portion G11 and the second portion G12, which extend in the directions different from the vertical direction while intersecting the plane (horizontal plane) including the medium widthwise direction and the medium feeding direction, have the channel lengths which are not less than halves of the channel lengths of the first, second, third, and fourth branched discharge branched-channels $D_{21}$, $D_{12}$, $D_{23}$, $D_{14}$.

Note that in consideration of, for example, the manufacturing error of each of the parts for constructing the channels, the mutual assembling error of each of the parts for constructing the channels, and the error resulting from the shape change (for example, any deformation of the resin tube) of each of the parts possibly caused upon the assembling, it is not necessarily easy and not essential as well to obtain the completely identical channel resistance for the two channels. In this embodiment, for example, if the error of the channel resistance of the first supply branched-channel $S_1$ with respect to the channel resistance of the second supply branched-channel $S_2$ is within 10% of the channel resistance of the second supply branched-channel $S_2$, then it is possible to realize the equal amount branching, and it is possible to favorably suppress any uneven density upon the image formation (details will be described later on). Similarly, if the error of the channel resistance of the first discharge branched-channel $D_1$ with respect to the channel resistance of the second discharge branched-channel $D_2$ is within 10% of the channel resistance of the second discharge branched-channel $D_2$, then it is possible to realize the equal amount branching, and it is possible to favorably suppress any uneven density upon the image formation (details will be described later on).

In this specification and in the present disclosure, the phrase "the channel resistance of a certain channel is the same as (identical to) the channel resistance of another channel" means that the error of the channel resistance of the certain channel with respect to the channel resistance of the another channel is within 10% of the channel resistance of the another channel. The phrase "the cross-sectional area of a certain channel is the same as (identical to) the cross-sectional area of another channel" means that the error of the cross-sectional area of the certain channel with respect to the cross-sectional area of the another channel is less than 10% of the cross-sectional area of the another channel. The phrase "the channel length of a certain channel is the same as (identical to) the channel length of another channel" means that the error of the channel length of the certain channel with respect to the channel length of the another channel is less than 10% of the channel length of the another channel. Note that when the cross-sectional area of a certain channel is compared with the cross-sectional area of another channel, if the cross-sectional area is not constant in the entire region of the channel, then it is possible to use an average value of the cross-sectional areas in the entire region of the channel. Further, the phrase "the flow rate of the liquid flowing through a certain channel is the same as (identical to) the flow rate of the liquid flowing through another channel" means that the error of the flow rate of the liquid flowing through the certain channel with respect to the flow rate of the liquid flowing through the another channel is within 10% of the flow rate of the liquid flowing through the another channel.

<Image Forming Method>

The image formation is performed as follows on the medium PM by using the printer 1000 and the head unit 100.

At first, the medium PM accommodated in a feed tray (not depicted) is fed to the supply side of the conveying roller 801, and the medium PM is fed by the conveying roller 801 to the position on the platen 700. The plurality of head systems HS1 of the head units 100 continuously eject the liquid droplets of the inks to the medium PM fed in the medium feeding direction by the conveying rollers 801, 802 to progressively form the image on the medium PM. The medium PM, on which the image has been formed, is fed to the discharge side of the conveying roller 802, and the medium PM is discharged to a discharge tray (not depicted).

The ejection of the liquid droplets of the ink based on the use of the head system HS1 is performed by applying the pressure to the ink contained in a predetermined pressure chamber 1 (referred to as "target pressure chamber") by using the piezoelectric actuator 62. Specifically, the driver IC 633 is firstly operated under the instruction of the controller CONT to apply the driving electric potential to the individual electrode 624 corresponding to the target pressure chamber by the aid of FPC 632. Accordingly, the electric field, which is parallel to the polarization direction, is generated in the active portion 622*a* interposed between the common electrode 623 and the individual electrode 624 to which the driving electric potential is applied, and the active portion 622*a* is shrunk in the horizontal direction orthogonal to the polarization direction. As a result, the ink sealing film 61A, which is disposed over or above the target pressure chamber, is vibrated, and the pressure is applied to the ink contained in the target pressure chamber. The liquid droplet of the ink is ejected from the nozzle 3 communicated with the pressure chamber 1 via the descender channel 2.

The ink contained in the subtank ST is continuously supplied to the pressure chamber 1 via the supply channel S and the manifolds M1 to M4. Further, the ink, which is included in the ink contained in the manifolds M1 to M4 and which is not supplied to the pressure chamber 1, is fed to the drain tank DT via the discharge channel D. The flow of the ink, which passes through the supply channel S and the discharge channel D from the subtank ST to the drain tank DT, is generated, for example, by the pump PP. Further, the ink, which is returned to the drain tank DT, passes through a filter (not depicted), and the ink is returned to the subtank ST by the pump PP.

The orientation (direction) of the flow of the ink in the manifolds M1, M3 and the orientation (direction) of the flow of the ink in the manifolds M2, M4 are mutually opposite to each other in the head system HS1 of this embodiment. The reason is as follows.

In general, a temperature of the ink to be ejected from the nozzle of the head, is lowered while flowing in the channel from the ink tank to the nozzle, for the following reason. That is, the ambient temperature (outdoor temperature) is lower than the optimum temperature of the ink (for example, about 40° C.).

The inventor of the present disclosure has found out that the quality of the image to be formed may be deteriorated depending on the temperature decrease of the ink described above. Specifically, this phenomenon is caused for the following reason.

The ink is the liquid, and the viscosity changes depending on the temperature. In the meantime, the amount of the ink, which is to be ejected from the nozzle in accordance with the application of the pressure in the pressure chamber, may be decreased in the individual channel to which the ink having the increased viscosity due to lowered temperature is supplied. The temperature of the ink is gradually lowered in the channel directed from the ink tank to the pressure chamber.

Therefore, the ink, which has a lower temperature (higher viscosity), is supplied to the pressure chamber which is positioned on the more downstream side. When the ink having the high viscosity is supplied to a predetermined pressure chamber as described above, then the ejection amount from the concerning pressure chamber is decreased, and the deterioration of the quality such as the uneven density (depth) or the like may occur in the image formed on the medium PM.

As a specified example, a situation is assumed, in which the ink is caused to flow in an identical direction through all of the manifolds M1 to M4 depicted in FIG. 7. If the ink is caused to flow in the direction directed from the left side to the right side in the medium widthwise direction through all of the manifolds M1 to M4, then the ink having a relatively high temperature is supplied to the individual channel ICH disposed in the vicinity of the left end as the upstream side, and the ink having a relatively low temperature is supplied to the individual channel ICH disposed in the vicinity of the right end as the downstream side. Therefore, the amount of the ink, which is ejected from the nozzle 3 of the individual channel ICH disposed in the vicinity of the right end, is smaller than the amount of the ink which is ejected from the nozzle 3 of the individual channel ICH disposed in the vicinity of the left end. Any uneven density arises in the formed image.

On the contrary, in the head system HS1 of the first embodiment, the ink is supplied and discharged with respect to the head 60 so that the orientation (direction) of the flow of the ink in the manifolds M1, M3 and the orientation (direction) of the flow of the ink in the manifolds M2, M4 are mutually opposite (opposite to each other). Accordingly, any uneven density is offset for the image formed by the nozzle array $L_3$ corresponding to each of the manifolds.

The manifold M1 and the manifold M2 are specifically considered as follows. As for the manifold M1, the ink having a relatively high temperature is supplied to the individual channel ICH connected to the manifold M1 on the left side (upstream side) in the medium widthwise direction, and the ink having a relatively low temperature is supplied to the individual channel ICH connected to the manifold M1 on the right side (downstream side) in the medium widthwise direction. Therefore, the image, which is formed by the ink ejection from the nozzle array $L_3$ of the pressure chamber array Lim connected to the manifold M1, has such a tendency that the density is high on the left side in the medium widthwise direction and the density is lowered at positions nearer to the right side.

On the other hand, as for the manifold M2, the ink having a relatively high temperature is supplied to the individual channel ICH connected to the manifold M2 on the right side (upstream side) in the medium widthwise direction, and the ink having a relatively low temperature is supplied to the individual channel ICH connected to the manifold M2 on the left side (downstream side) in the medium widthwise direction. Therefore, the image, which is formed by the ink ejected from the nozzle array $L_3$ of the pressure chamber array Lim connected to the manifold M2, has such a tendency that the density is high on the right side in the medium widthwise direction and the density is lowered at positions nearer to the left side.

In this case, the nozzle array $L_3$ connected to the manifold M1 is disposed closely to the nozzle array $L_3$ connected to the manifold M2. Therefore, as for the image formed on the medium PM, the uneven density of the image formed by the nozzle array $L_3$ connected to the manifold M1 and the uneven density of the image formed by the nozzle array $L_3$ connected to the manifold M2 are offset to some extent. That is, the image, which is formed by the nozzle array $L_3$ connected to the manifold M1 and which has such a tendency that the density is the thickest at the left end in the medium widthwise direction and the density is thinned at positions nearer to the right side in the medium widthwise direction, is formed closely to the image which is formed by the nozzle array $L_3$ connected to the manifold M2 and which has such a tendency that the density is the thickest at the right end in the medium widthwise direction and the density is thinned at positions nearer to the left side in the medium widthwise direction. Accordingly, the uneven densities of the both images are averaged, and the uneven densities are dissolved or suppressed as a whole.

As described above, in the head system HS1 of the first embodiment, the deterioration of the image quality is suppressed by combining the density of the image formed by a certain nozzle and the density of the image formed by another nozzle adjacent to the certain nozzle. In this case, the certain nozzle is connected to only the corresponding single manifold, and the certain nozzle is not connected to any other manifold. Further, the nozzle adjacent to the certain nozzle is also connected to only the corresponding single manifold, and the nozzle adjacent to the certain nozzle is not connected to any other manifold. The manifold to which the certain nozzle is connected and the manifold to which the nozzle adjacent to the certain nozzle is connected are the different manifolds which are adjacent to one another. That is, the uneven densities are averaged between the nozzles which do not share the manifold in the head system HS1 of the first embodiment. Further, the uneven densities are averaged in the head system HS1 of the first embodiment by causing the droplets of the ink ejected from the adjacent nozzles to be close or overlapped at the outside of the head 60, specifically on the medium PM, without causing the flows of the ink having the different temperatures to merge in the head 60. Accordingly, it is possible to suppress the deterioration of the image quality without bringing about any complicated channel structure, and without bringing about any large-sized head which would be otherwise brought about by the complicated channel structure.

The uneven densities are also offset (averaged) in the same manner as described above between the manifold M2 and the manifold M3 and between the manifold M3 and the manifold M4.

The effect of the head system HS1 of the first embodiment will be summarized below.

The supply channel S and the discharge channel D of the head system HS1 of the first embodiment have a configuration for supplying and discharging the ink with respect to the manifolds of the head 60 which are arranged adjacently to one another in the medium feeding direction, so that the orientations (directions) of the flows of the ink in those manifolds are opposite to one another. Therefore, the uneven densities, which may be caused in the images formed by the nozzle arrays $L_3$ corresponding to the respective manifolds, can be offset between the manifolds adjacent to one another in the medium feeding direction (between the nozzle arrays adjacent to one another in the medium feeding direction). It is possible to suppress the deterioration of the quality of the image to be formed.

In the head system HS1 of the first embodiment, any one of the manifolds M1 to M4 of the head 60 has the linear or straight shape which extends in the medium widthwise direction. Therefore, the channel length is short as compared with, for example, a manifold which has a U-shaped form in a plan view, which extends from an ink supply port (upstream end) to one side in the medium widthwise direction, and which thereafter turns to extend to the ink discharge side (downstream side). Therefore, the difference is small between the temperature of the ink supplied to the pressure chamber connected to the vicinity of the upstream end of the manifold and the temperature of the ink supplied to the pressure chamber connected to the vicinity of the downstream end of the manifold. The deterioration of the image quality, which depends on the temperature change of the ink, is suppressed.

In the head system HS1 of the first embodiment, the first, second, third, and fourth branched supply branched-channels $S_{11}$, $S_{22}$, $S_{13}$, $S_{24}$ of the supply channel S and the first, second, third, and fourth branched discharge branched-channels $D_{21}$, $D_{12}$, $D_{23}$, $D_{14}$ of the discharge channel D are formed by the first and second channel blocks 41, 42. In this way, the areas of the supply channel S and the discharge channel D, which are subjected to the second stage branching and which have the largest numbers of the channels, are formed at the inside of the block-shaped members. Thus, the channels can be efficiently arranged in the limited space on or above the head 60, and it is possible to miniaturize the head system HS1.

The ink supply system ISS1, the printing apparatus 1000, and the ink flow method of the first embodiment also provide the same or equivalent effect as that of the head system HS1.

Modified Embodiment 1-1

Figure 10A:
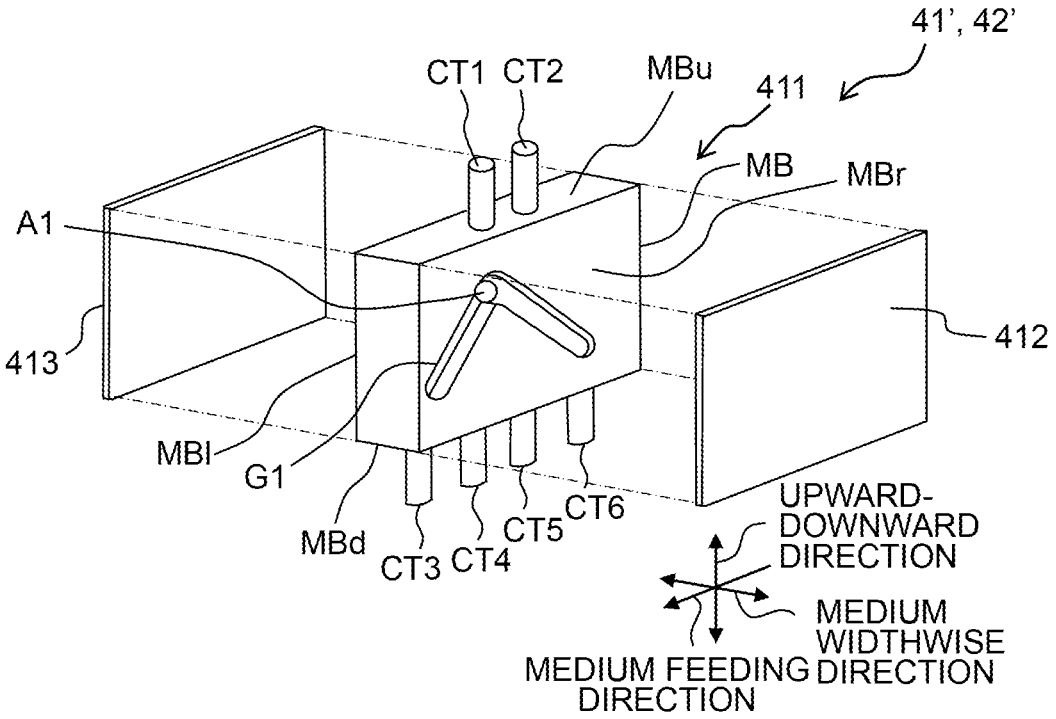
FIG. 10A is an exploded perspective view depicting each of first and second channel blocks according to a modified embodiment 1-1.
Figure 10B:
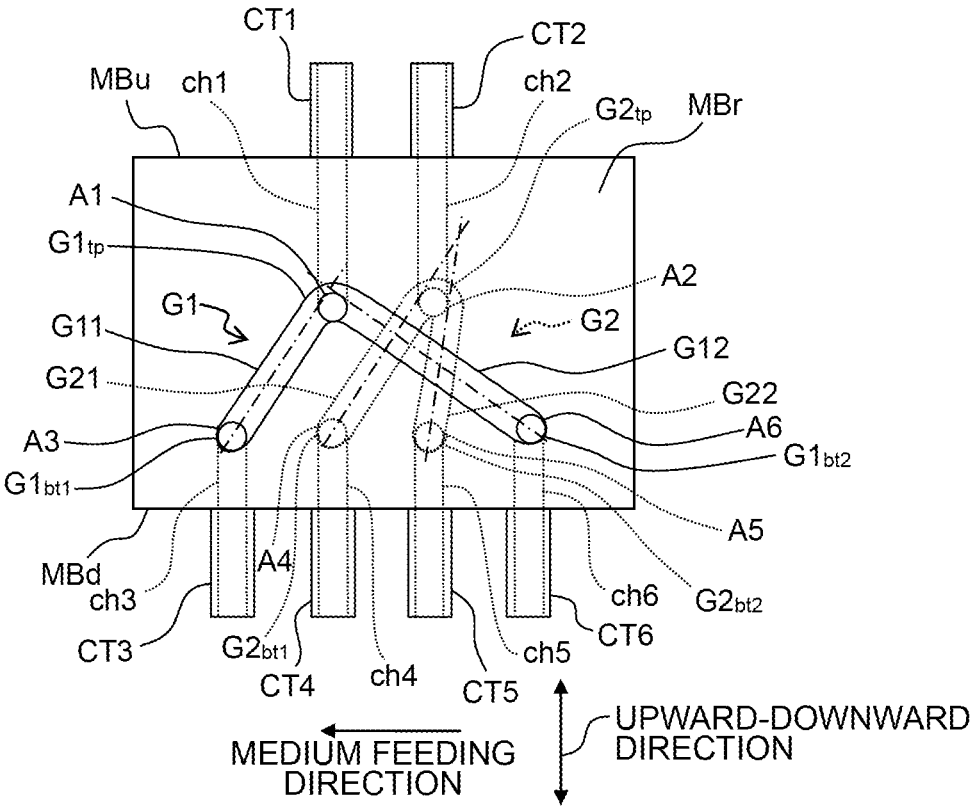
FIG. 10B is a side view depicting a channel forming unit of each of the first and second channel blocks according to the modified embodiment 1-1.

Next, an explanation will be made with reference to FIGS. 10A, 10B, and 11 about a head system HS1' of a modified embodiment 1-1.

The head system HS1' of the modified embodiment 1-1 is provided with first and second channel blocks 41', 42' (FIGS. 10A and 10B) in place of the first and second channel blocks 41, 42 provided for the head system HS1 of the first embodiment. The other features are the same as those of the head system HS1 of the first embodiment, any explanation of which will be omitted.

As for the first and second channel blocks 41', 42', unlike the first and second channel blocks 41, 42, a second portion G12 of a recessed groove G1 is connected to the channel ch6, and a second portion G22 of a recessed groove G2 is connected to the channel ch5.

Specifically, the lower end portion of the channel ch1 is communicated with the recessed groove G1 via an opening A1 formed at a top portion $G1_{tp}$ of the recessed groove G1, and the upper end portion of the channel ch1 is communicated with the connecting tube CT1 disposed on the upper surface MBu of the main body portion MB. The upper end portion of the channel ch3 is communicated with the recessed groove G1 via an opening A3 formed at a lower end portion $G1_{bt1}$ of the recessed groove G1, and the lower end portion of the channel ch3 is communicated with the connecting tube CT3 disposed on the lower surface MBd of the main body portion MB. The upper end portion of the channel ch6 is communicated with the recessed groove G1 via an opening A6 formed at a lower end portion $G1_{bt2}$ of the recessed groove G1, and the lower end portion of the channel ch6 is communicated with the connecting tube CT6 disposed on the lower surface MBd of the main body portion MB.

The lower end portion of the channel ch2 is communicated with the recessed groove G2 via an opening A2 formed at a top portion $G2_{tp}$ of the recessed groove G2, and the upper end portion of the channel ch2 is communicated with the connecting tube CT2 disposed on the upper surface MBu of the main body portion MB. The upper end portion of the channel ch4 is communicated with the recessed groove G2 via an opening A4 formed at a lower end portion $G2_{bt1}$ of the recessed groove G2, and the lower end portion of the channel ch4 is communicated with the connecting tube CT4 disposed on the lower surface MBd of the main body portion MB. The upper end portion of the channel ch5 is communicated with the recessed groove G2 via an opening A5 formed at a lower end portion $G2_{bt2}$ of the recessed groove G2, and the lower end portion of the channel ch5 is communicated with the connecting tube CT5 disposed on the lower surface MBd of the main body portion MB.

In relation to the first and second channel blocks 41', 42', the channel length of the first portion G11 of the recessed groove G1 is shorter than the channel length of the second portion G12. Therefore, the cross-sectional area of the second portion G12 is larger than the cross-sectional area of the first portion G11 so that the channel resistance of the first portion G11 is equal to (identical to) the channel resistance of the second portion G12. Similarly, the cross-sectional area of the second portion G22 is smaller than the cross-sectional area of the first portion G21 so that the channel resistance of the first portion G21 of the recessed groove G2 is equal to (identical to) the channel resistance of the second portion G22.

The first and second channel blocks 41', 42' can be arbitrarily configured such that a channel for connecting one of the channels ch1, ch2 to the channel ch3 and the channel ch6 is formed on one surface of the main body portion MB, and a channel for connecting the other of the channels ch1, ch2 to the channel ch4 and the channel ch5 is formed on the other surface of the main body portion MB.

An ink supply system ISS1' of the modified embodiment 1-1, which includes the head system HS1' of the modified embodiment 1-1, is provided with the first and second channel blocks 41', 42' in place of the first and second channel blocks 41, 42, and thus a supply channel S' and a discharge channel D' (FIG. 11) are constructed in place of the supply channel S and the discharge channel D. The supply channel S' and the discharge channel D' are configured so that the ink is caused to flow from the left side toward the right side in the medium widthwise direction in the manifolds M1, M4, and the ink is caused to flow from the right side toward the left side in the medium widthwise direction in the manifolds M2, M3.

Figure 11:
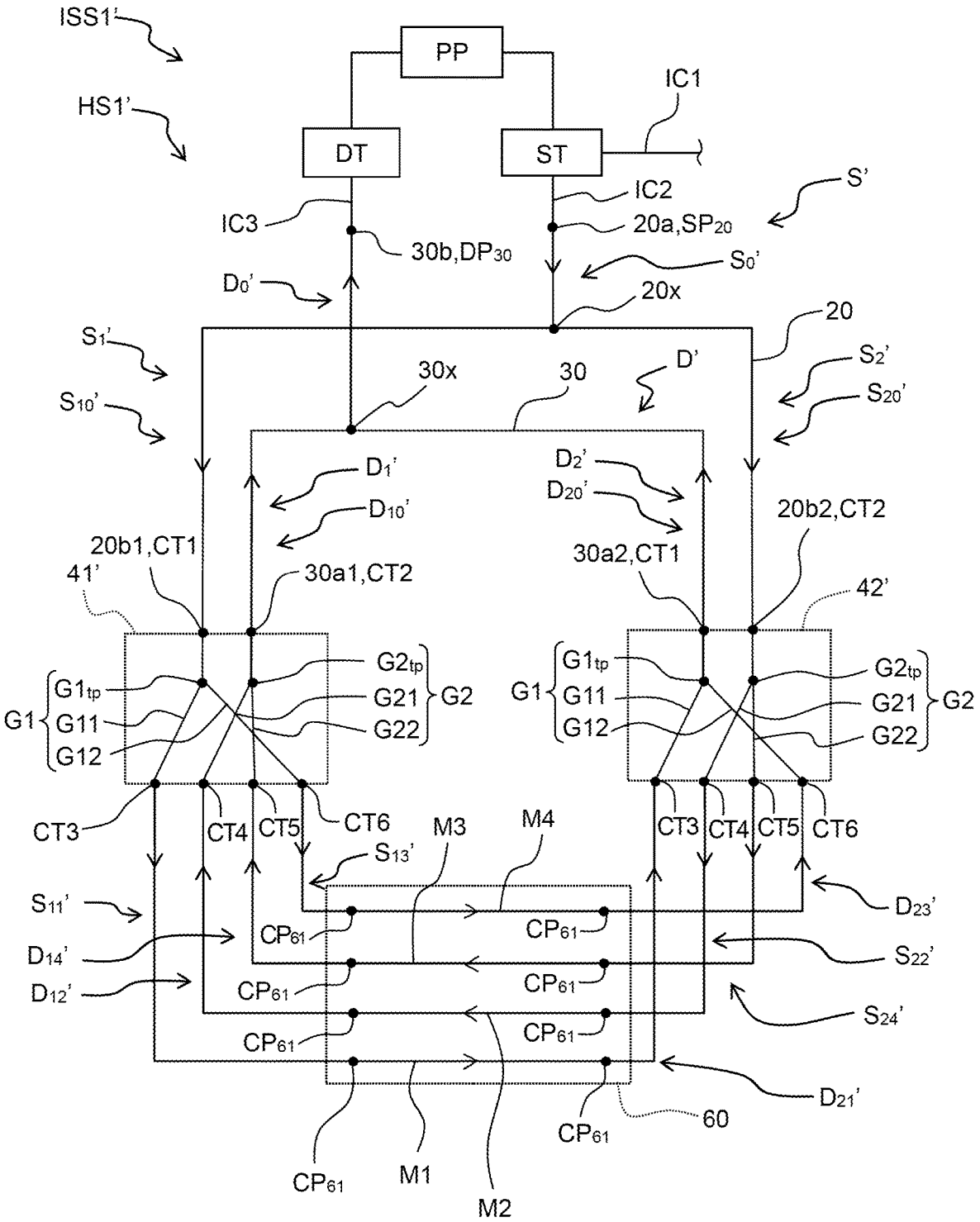
FIG. 11 is an explanatory drawing depicting channels formed by an ink supply system according to the modified embodiment 1-1.

Specifically, as depicted in FIG. 11, the ink, which flows from the subtank ST toward the first channel block 41', is divided into two flows of the ink at the top portion $G1_{tp}$ of the recessed groove G1. One flow of the ink passes through the first portion G11 of the recessed groove G1, the channel ch3, and the connecting tube CT3, and the flow of the ink flows into the manifold M1. The other flow of the ink passes through the second portion G12 of the recessed groove G1, the channel ch6, and the connecting tube CT6, and the flow of the ink flows into the manifold M4. The ink, which flows from the subtank ST toward the second channel block 42', is divided into two flows of the ink at the top portion $G2_{tp}$ of the recessed groove G2. One flow of the ink passes through the first portion G21 of the recessed groove G2, the channel ch4, and the connecting tube CT4, and the flow of the ink flows into the manifold M2. The other flow of the ink passes through the second portion G22 of the recessed groove G2, the channel ch5, and the connecting tube CT5, and the flow of the ink flows into the manifold M3.

The ink which passes through the manifold M1 and which flows into the second channel block 42' from the connecting tube CT3 of the second channel block 42' and the ink which passes through the manifold M4 and which flows into the second channel block 42' from the connecting tube CT6 of the second channel block 42' merge at the top portion $G1_{tp}$ of the recessed groove G1 of the second channel block 42', and the ink is fed to the drain tank DT via the connecting tube CT1 of the second channel block 42'. The ink which passes through the manifold M2 and which flows into the first channel block 41' from the connecting tube CT4 of the first channel block 41' and the ink which passes through the manifold M3 and which flows into the first channel block 41' from the connecting tube CT5 of the first channel block 41' merge at the top portion $G2_{tp}$ of the recessed groove G2 of the first channel block 41', and the ink is fed to the drain tank DT via the connecting tube CT2 of the first channel block 41'.

In this case, the channel, which is formed between the upstream end 20*a* of the ink supply tube 20 and the junction 20*x*, is the common supply channel $S_0'$. The channel, which extends from the junction 20*x* of the ink supply tube 20 via the first channel block 41' to arrive at the head 60, is the first supply branched-channel $S_1'$. The channel, which extends from the junction 20*x* of the ink supply tube 20 via the second channel block 42' to arrive at the head 60, is the second supply branched-channel $S_2'$.

The channel, which is included in the first supply branched-channel $S_1'$ and which is formed between the junction 20*x* of the ink supply tube 20 and the top portion $G1_{tp}$ of the recessed groove G1 of the first channel block 41', is the first common supply branched-channel $S_{10}'$. The channels, which are formed between the top portion $G1_{tp}$ and the manifolds M1, M4, are the first and third branched supply branched-channels $S_{11}'$, $S_{13}'$, respectively. The channel, which is included in the second supply branched-channel $S_2'$ and which is formed between the junction 20*x* of the ink supply tube 20 and the top portion $G2_{tp}$ of the recessed groove G2 of the second channel block 42', is the second common supply branched-channel $S_{20}'$. The channels, which are formed between the top portion $G2_{tp}$ and the manifolds M2, M3, are the second and fourth branched supply branched-channels $S_{22}'$, $S_{24}'$, respectively.

Further, the channel, which is formed between the downstream end 30*b* of the ink discharge tube 30 and the junction 30*x*, is the common discharge channel $D_0'$. The channel, which extends from the junction 30*x* of the ink discharge tube 30 via the first channel block 41' to arrive at the head 60, is the first discharge branched-channel $D_1'$. The channel, which extends from the junction 30*x* of the ink discharge tube 30 via the second channel block 42' to arrive at the head 60, is the second discharge branched-channel $D_2'$.

The channel, which is included in the first discharge branched-channel $D_1'$ and which is formed between the junction 30*x* of the ink discharge tube 30 and the top portion $G2_{tp}$ of the recessed groove G2 of the first channel block 41', is the first common discharge branched-channel $D_{10}'$. The channels, which are formed between the top portion $G2_{tp}$ and the manifolds M2, M3, are the second and fourth branched discharge branched-channels $D_{12}'$, $D_{14}'$, respectively. The channel, which is included in the second discharge branched-channel $D_2'$ and which is formed between the junction 30*x* of the ink discharge tube 30 and the top portion $G1_{tp}$ of the recessed groove G1 of the second channel block 42', is the second common discharge branched-channel $D_{20}'$. The channels, which are formed between the top portion $G1_{tp}$ and the manifolds M1, M4, are the first and third branched discharge branched-channels $D_{21}'$, $D_{23}'$, respectively.

Also in the head system HS1' of the modified embodiment 1-1, the uneven densities are offset (averaged) between the manifold M1 and the manifold M2 and between the manifold M3 and the manifold M4 in accordance with the same or equivalent mechanism as that of the head system HS1 of the first embodiment. The deterioration of the quality of the image to be formed is suppressed.

The following modified modes can be also used for the head system HS1 of the first embodiment and the head system HS1' of the modified embodiment. The respective modified modes described below are described for the head system HS1 of the first embodiment. However, the same or equivalent modifications may be used for the head system HS1' of the modified embodiment 1-1.

In the supply channel S of the head system HS1 of the first embodiment, the common supply channel $S_0$ is branched at the junction 20*x* into the first and second common supply branched-channels $S_{10}$, $S_{20}$ which are further branched in the first and second channel blocks 41, 42 into the first, second, third, and fourth branched supply branched-channels $S_{11}$, $S_{22}$, $S_{13}$, $S_{24}$. However, there is no limitation thereto. The supply channel S may be arbitrarily configured so that the ink is supplied from one side in the medium widthwise direction to the manifolds M1, M3, and the ink is supplied from the other side in the medium widthwise direction to the manifolds M2, M4.

Specifically, for example, it is possible to adopt such configuration that the common supply channel $S_0$ is branched into four, i.e., such configuration that the upstream ends of the first, second, third, and fourth branched supply branched-channels $S_{11}$, $S_{22}$, $S_{13}$, $S_{24}$ are connected to the downstream end of the common supply channel $S_0$. The channels as described above may be formed by using a tubular member which is branched into four on the route, in place of the ink supply tube 20 and the first and second channel blocks 41, 42.

The discharge channel D of the head system HS1 of the first embodiment may also be modified in the similar manner as above described modified modes.

In the head system HS1 of the first embodiment, it is also allowable to use a tubular member which is branched into two on the route, in place of the first and second channel members 41, 42. Further, the entire region of the supply channel S and/or the discharge channel D may be formed by using a tubular member such as a resin tube or the like.

In the head system HS1 of the first embodiment, the greater parts of the common supply channel $S_0$ and the first and second common supply branched-channels $S_{10}$, $S_{20}$ are formed with the ink supply tube 20. However, there is no limitation thereto. The common supply channel $S_0$ and the first and second common supply branched-channels $S_{10}$, $S_{20}$ may be formed, for example, at the inside of the first and second channel blocks 41, 42. Further, the entire region of the supply channel S and/or the discharge channel D may be formed at the inside of a block-shaped member.

In the head system HS1 of the first embodiment, the first and second channel members 41, 42 may be provided as an integrated or monolithic member.

The head system HS1 of the first embodiment is configured so that the ink is caused to flow through the four manifolds. However, there is no limitation thereto. The head system HS1 may be configured so that the ink is caused to flow through two manifolds. Alternatively, the head system HS1 may be configured so that the ink is caused to flow through any arbitrary even number of manifolds, for example, six or eight manifolds. The uneven temperature of the ink flowing through the manifold is more favorably dissolved, and consequently the uneven density upon the image formation is more favorably dissolved, provided that the number of manifolds through which the ink is caused to flow from one side to the other side in the medium widthwise direction is the same as the number of manifolds through which the ink is caused to flow from the other side to one side in the medium widthwise direction.

A modified mode, in which the ink is caused to flow through two manifolds which are adjacent to one another in the medium feeding direction so that the directions of the flows of the ink in those manifolds are opposite to one another, is obtained, for example, by omitting the second portion G12 of the recessed groove G1, the second portion G22 of the recessed groove G2, and the connecting tubes CT5, CT6 from the first channel member 41 and the second channel member 42.

Second Embodiment

Next, an explanation will be made with reference to FIGS. 12 to 14 about a head system HS2 of a second embodiment of the present disclosure.

The head system HS2 of the second embodiment is configured so that two different types of inks (for example, black ink and yellow ink) can be flown through one head unit 100. Specifically, the head system HS2 of the second embodiment uses a channel member 70 (FIGS. 12 and 13) in place of the ink supply tube 20, the ink discharge tube 30, the first channel block 41, and the second channel block 42 of the first embodiment.

Figure 14:
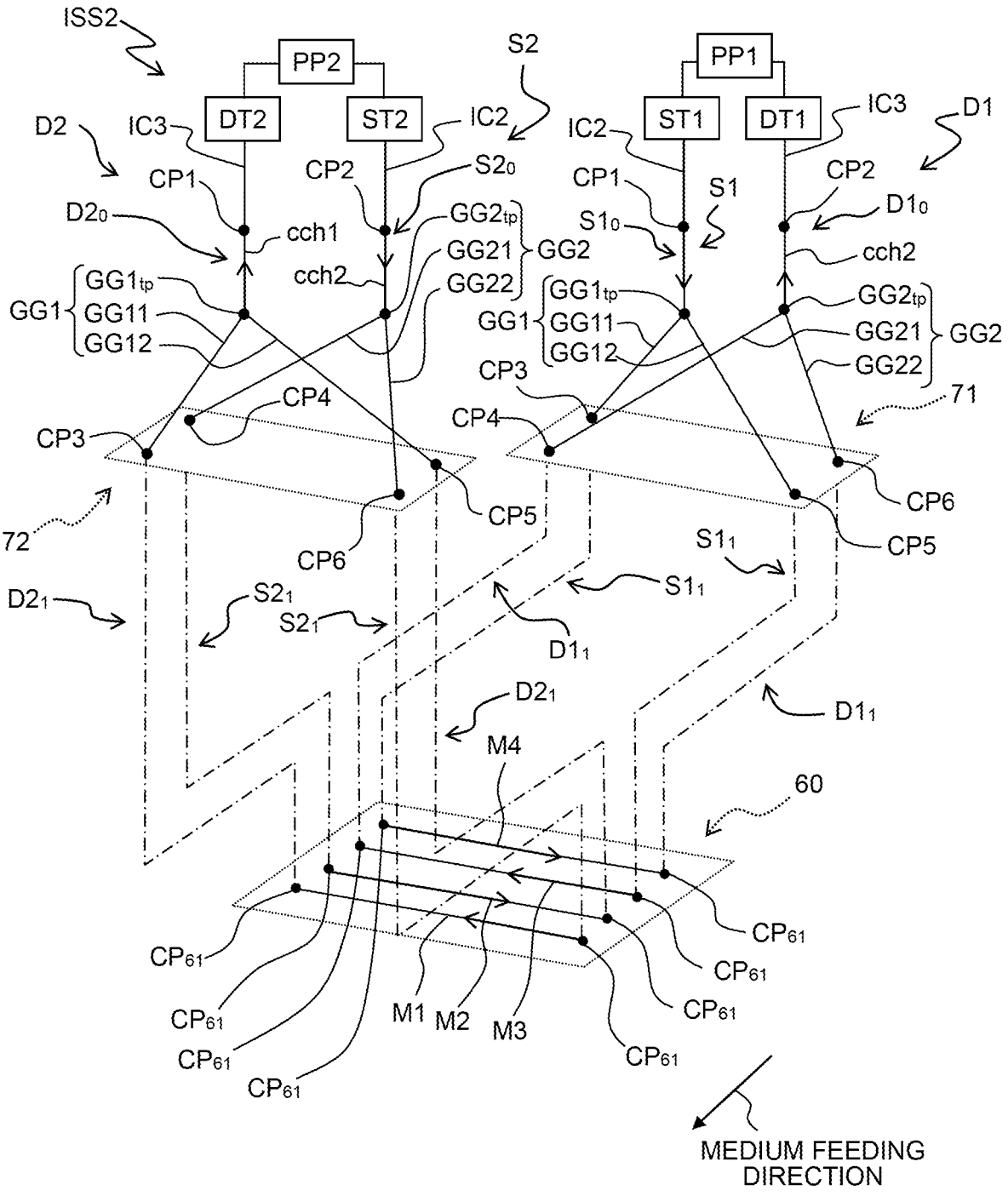
FIG. 14 is an explanatory drawing depicting channels formed by an ink supply system according to the second embodiment of the present disclosure.

Further, a printing apparatus 1000, which is usable together with the head system HS2 of the second embodiment, is provided with first and second subtanks (fill tanks) ST1, ST2 in place of the subtank (fill tank) ST, and is provided with first and second drain tanks DT1, DT2 in place of the drain tank DT (FIG. 14). A first pump PP1 is provided between the first subtank ST1 and the first drain tank DT1, and a second pump PP2 is provided between the second subtank ST2 and the second drain tank DT2. An ink supply system ISS2 of the second embodiment is configured by the head system HS2, and the first and second subtanks ST1, ST2, the first and second drain tanks DT1, DT2, and the first and second pumps PP1, PP2 connected thereto.

The other constitutive components are the same as those of the head system HS1 of the first embodiment. Therefore, any explanation thereof will be omitted.

Figure 12:
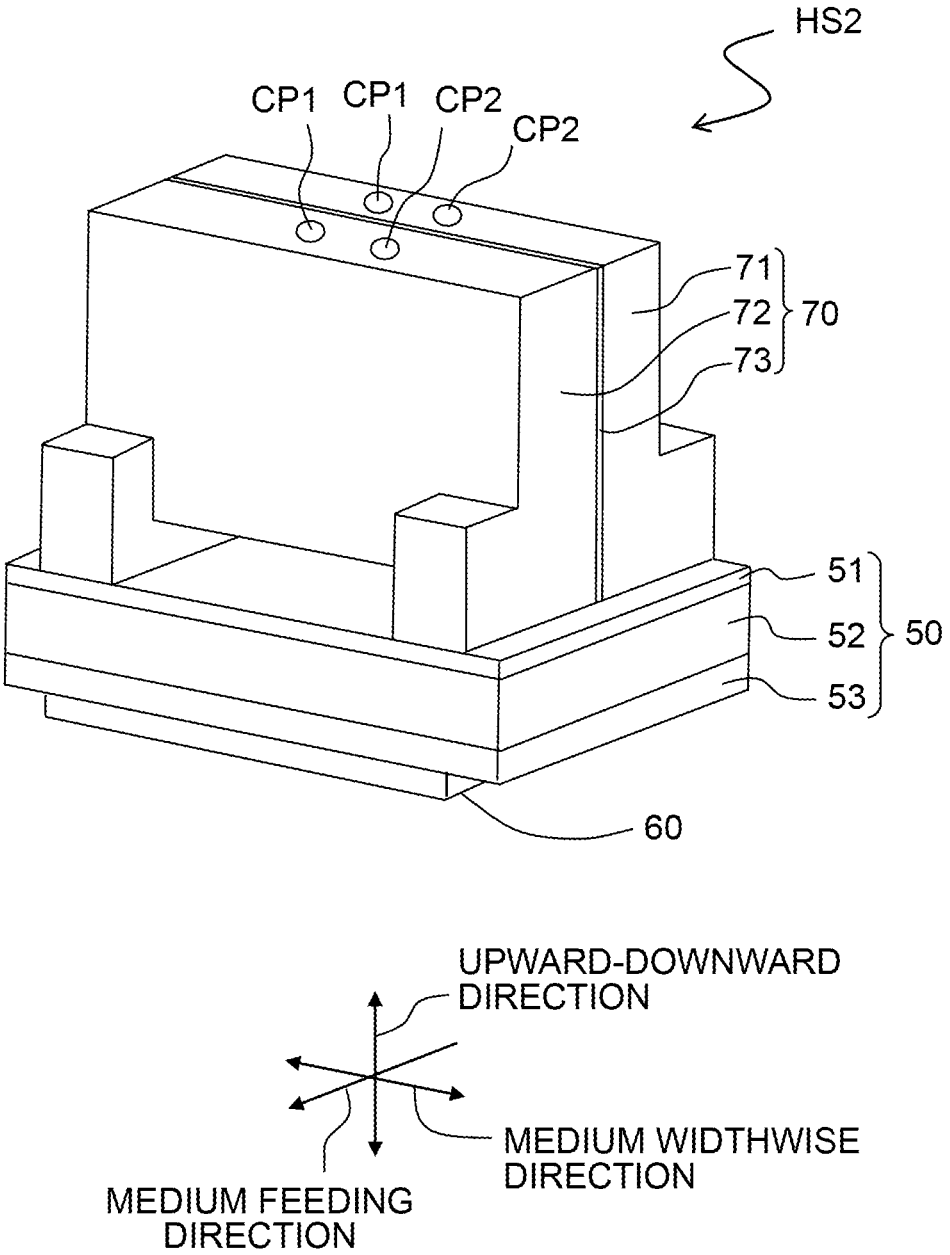
FIG. 12 is a perspective view depicting a head system according to a second embodiment of the present disclosure.
Figure 13:
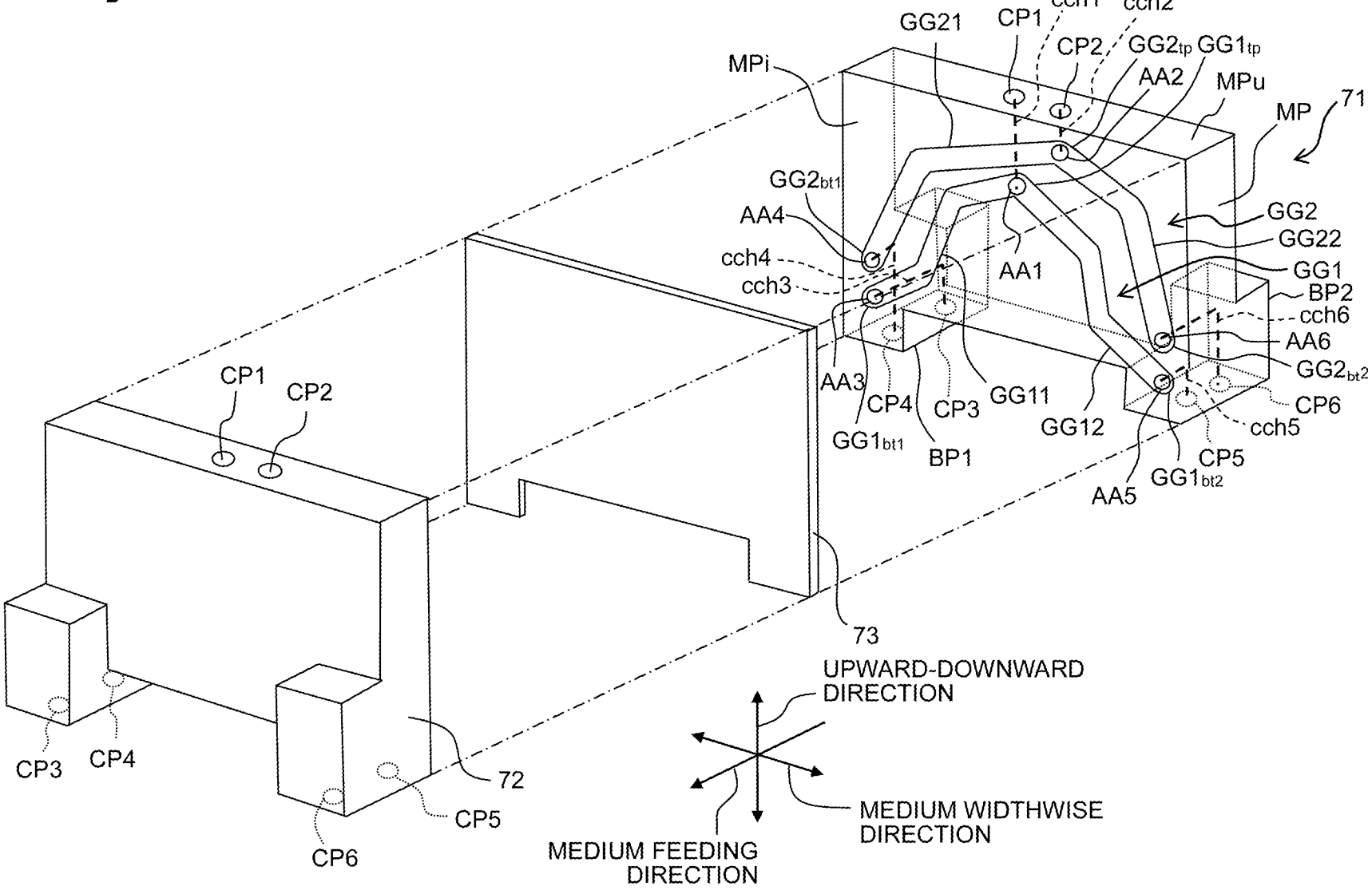
FIG. 13 is an exploded perspective view depicting a channel member.

As depicted in FIGS. 12 and 13, the channel member 70 has a first channel block (first channel-forming member) 71, a second channel block (second channel-forming member) 72, and a rubber sheet (elastic sheet) 73 which intervenes therebetween.

The first channel block 71 is formed, for example, of a resin such as POM or the like. The first channel block 71 has a rectangular plate-shaped main portion MP, a first base portion BP1 which protrudes downwardly and to the supply side from a lower left corner of the main portion MP, and a second base portion BP2 which protrudes downwardly and to the supply side from a lower right corner of the main portion MP.

Ink flow ports CP1, CP2 are formed on the upper surface MPu of the main portion MP while being aligned in the medium widthwise direction. The ink flow port CP1 is positioned on the left side of the central portion in the medium widthwise direction of the main portion MP, and the ink flow port CP2 is positioned on the right side of the central portion in the medium widthwise direction of the main portion MP.

Ink flow ports CP3, CP4 are formed on the lower surface of the base portion BP1 while being aligned in the medium feeding direction. The ink flow port CP3 is positioned on the supply side, and the ink flow port CP4 is positioned on the discharge side. Ink flow ports CP5, CP6 are formed on the lower surface of the base portion BP2 while being aligned in the medium feeding direction. The ink flow port CP6 is positioned on the supply side, and the ink flow port CP5 is positioned on the discharge side.

A first recessed groove GG1 and a second recessed groove GG2 are formed on the inner surface MPi (surface directed to the discharge side in the medium feeding direction) of the main portion MP.

The first recessed groove GG1 has a substantially inverted V-shaped form. The first recessed groove GG1 includes a first portion GG11 which extends from the top portion $GG1_{tp}$ downwardly to the left side in the medium widthwise direction to arrive at a lower end portion $GG1_{bt1}$, and a second portion GG12 which extends from the top portion $GG1_{tp}$ downwardly to the right side in the medium widthwise direction to arrive at a lower end portion $GG1_{bt2}$.

The top portion $GG1_{tp}$ is positioned on the left side as compared with the central portion in the medium widthwise direction of the inner surface MPi. The lower end portion $GG1_{bt1}$ is positioned in the vicinity of the left end of the inner surface MPi, and the lower end portion $GG1_{bt2}$ is positioned in the vicinity of the right end of the inner surface MPi. As viewed in the medium feeding direction, the lower end portion $GG1_{bt1}$ is positioned in the area in which the first base portion BP1 is provided, and the lower end portion $GG1_{bt2}$ is positioned in the area in which the second base portion BP2 is provided. The top portion $GG1_{tp}$ is positioned on the left side as compared with the central portion in the medium widthwise direction of the inner surface MPi. Therefore, the channel length of the first portion GG11 is shorter than the channel length of the second portion GG12.

The extending directions of the first portion GG11 and the second portion GG12 are inclined by predetermined angles with respect to the upward-downward direction (vertical direction). The first portion GG11 is bent twice on the route to arrive at the lower end portion $GG1_{bt1}$ from the top portion $GG1_{tp}$. Every time when the first portion GG11 is bent, the angle of inclination with respect to the upward-downward direction is changed. Similarly, the second portion GG12 is bent twice on the route to arrive at the lower end portion $GG1_{bt2}$ from the top portion $GG1_{tp}$. Every time when the second portion GG12 is bent, the angle of inclination with respect to the upward-downward direction is changed. As described above, when the channel is extended in the direction different from the vertical direction, then the extending direction of the channel may be inclined with respect to the horizontal direction, and thus it is possible to suppress the precipitation of the pigment onto the channel bottom surface. Consequently, it is possible to avoid the clogging or closing of the channel which would be otherwise caused such that the pigment precipitated on the channel bottom surface flows collectively at once. Further, any bubble, mixed into the ink, can be suppressed from staying on the channel upper surface, and it is possible to allow the bubble to flow upwardly more reliably. The angle of inclination of each of the first portion GG11 and the second portion GG12 with respect to the vertical axis extending downwardly from the top portion $GG1_{tp}$ may be set to an arbitrary angle of not more than 90°. Further, it is possible to adjust the channel length by changing the number of times of the bending on the route. The channel length can be lengthened by increasing the number of times of the bending. The channel length can be shortened by decreasing the number of times of the bending.

The second recessed groove GG2 is formed over or above the first recessed groove GG1. The second recessed groove GG2 has a substantially inverted V-shaped form. The second recessed groove GG2 includes a first portion GG21 which extends from the top portion $GG2_{tp}$ downwardly to the left side in the medium widthwise direction to arrive at a lower end portion $GG2_{bt1}$, and a second portion GG22 which extends from the top portion $GG2_{tp}$ downwardly to the right side in the medium widthwise direction to arrive at a lower end portion $GG2_{bt2}$.

The top portion $GG2_{tp}$ is positioned on the right side as compared with the central portion in the medium widthwise direction of the inner surface MPi. The lower end portion $GG2_{bt1}$ is positioned in the vicinity of the left end of the inner surface MPi, and the lower end portion $GG2_{bt2}$ is positioned in the vicinity of the right end of the inner surface MPi. As viewed in the medium feeding direction, the lower end portion $GG2_{bt1}$ is positioned in the area in which the first base portion BP1 is provided, and the lower end portion $GG2_{bt2}$ is positioned in the area in which the second base portion BP2 is provided. The top portion $GG2_{tp}$ is positioned on the right side as compared with the central portion in the medium widthwise direction of the inner surface MPi. Therefore, the channel length of the second portion GG22 is shorter than the channel length of the first portion GG21.

Channels cch1, cch2, which extend in the upward-downward direction, are formed at the inside of the main portion MP at positions overlapped with the top portions $GG1_{tp}$, $GG2_{tp}$ in the medium widthwise direction, respectively. The lower end portion of the channel cch1 is communicated with the first recessed groove GG1 via an opening AA1 formed at the top portion $GG1_{tp}$ of the first recessed groove GG1. The upper end portion of the channel cch1 is communicated with the ink flow port CP1 formed on the upper surface MPu of the main portion MP. The lower end portion of the channel cch2 is communicated with the second recessed groove GG2 via an opening AA2 formed at the top portion $GG2_{tp}$ of the second recessed groove GG2. The upper end portion of the channel cch2 is communicated with the ink flow port CP2 formed on the upper surface MPu of the main portion MP.

Those formed at the inside of the main portion MP and the base portion BP1 are a channel cch3 which connects the lower end portion $GG1_{bt1}$ of the first recessed groove GG1 and the ink flow port CP3 disposed on the lower surface of the base portion BP1, and a channel cch4 which connects the lower end portion $GG2_{bt1}$ of the second recessed groove GG2 and the ink flow port CP4 disposed on the lower surface of the base portion BP1.

The upper end portion of the channel cch3 is communicated with the first recessed groove GG1 via an opening AA3 formed at the lower end portion $GG1_{bt1}$ of the first recessed groove GG1. The channel cch3 extends from the upper end portion to the supply side in the medium feeding direction, and then the channel cch3 is bent downwardly to extend to the ink flow port CP3. The upper end portion of the channel cch4 is communicated with the second recessed groove GG2 via an opening AA4 formed at the lower end portion $GG2_{bt1}$ of the second recessed groove GG2. The channel cch4 extends from the upper end portion to the supply side in the medium feeding direction, and then the channel cch4 is bent downwardly to pass by the channel cch3 and extend to the ink flow port CP4. As depicted in FIG. 13, as for the channel length of the area extending horizontally toward the supply side in the medium feeding direction, the channel length concerning the channel cch3 is longer than the channel length concerning the channel cch4.

Those formed at the inside of the main portion MP and the base portion BP2 are a channel cch5 which connects the lower end portion $GG1_{bt2}$ of the first recessed groove GG1 and the ink flow port CP5 disposed on the lower surface of the base portion BP2, and a channel cch6 which connects the lower end portion $GG2_{bt2}$ of the second recessed groove GG2 and the ink flow port CP6 disposed on the lower surface of the base portion BP2.

The upper end portion of the channel cch5 is communicated with the first recessed groove GG1 via an opening AA5 formed at the lower end portion $GG1_{bt2}$ of the first recessed groove GG1. The channel cch5 extends from the upper end portion to the supply side in the medium feeding direction, and then the channel cch5 is bent downwardly to extend to the ink flow port CP5. The upper end portion of the channel cch6 is communicated with the second recessed groove GG2 via an opening AA6 formed at the lower end portion $GG2_{bt2}$ of the second recessed groove GG2. The channel cch6 extends from the upper end portion to the supply side in the medium feeding direction, and then the channel cch6 is bent downwardly to extend to the ink flow port CP6. As depicted in FIG. 13, as for the channel length of the area extending horizontally toward the supply side in the medium feeding direction, the channel length concerning the channel cch6 is longer than the channel length concerning the channel cch5. Further, as for the channel length of the area extending horizontally toward the supply side in the medium feeding direction, the channel length concerning the channel cch3 and the channel length concerning the channel cch6 are equal to one another, and the channel length concerning the channel cch4 and the channel length concerning the channel cch5 are equal to one another.

In the first channel block 71 of the second embodiment, the channel length of the first recessed groove GG1 and the channel lengths of the channels cch3, cch5 are set so that the channel length of the channel between the ink flow port CP1 and the ink flow port CP3 and the channel length of the channel between the ink flow port CP1 and the ink flow port CP5 are identical to one another. That is, the difference in the channel length between the channel cch3 and the channel cch5, which is caused by the deviation in the medium feeding direction between the position of the ink flow port CP3 and the position of the ink flow port CP5, is offset by positioning the top portion $GG1_{tp}$ of the first recessed groove GG1 on the left side in the medium widthwise direction so that the channel length of the first portion GG11 is shorter than the channel length of the second portion GG12.

Similarly, in the first channel block 71 of the second embodiment, the channel lengths of the first portion GG21 and the second portion GG22 of the second recessed groove GG2 and the channel lengths of the channels cch4, cch6 are set so that the channel length of the channel between the ink flow port CP2 and the ink flow port CP4 and the channel length of the channel between the ink flow port CP2 and the ink flow port CP6 are identical to one another.

The second channel block 72 has the structure of mirror symmetry with respect to the first channel block 71 in relation to the plane spreading in the upward-downward direction and the medium widthwise direction. In the following explanation, respective portions of the second channel block 72, which are positioned in mirror symmetry with respect to respective portions of the first channel blocks 71, are referred to with the same reference numerals as those of the respective portions of the first channel block 71.

A rubber sheet 73 is, for example, a sheet of EPDM or silicone. The rubber sheet 73 has substantially the same shape as those of the first and second channel blocks 71, 72 as viewed in the medium feeding direction. The thickness of the rubber sheet 73 is, for example, about 0.1 to 0.5 mm.

The first channel block 71 and the second channel block 72 are integrally joined to one another with the rubber sheet 73 intervening therebetween in a state in which the inner surfaces MPi of the respective main portions MP are opposed to one another.

The first recessed groove GG1 and the second recessed groove GG2 of the first and second channel blocks 71, 72 are covered with the rubber sheet 73. Thus, the branched channel configured by the channels cch1, cch3, cch5 and the first recessed groove GG1 and the branched channel configured by the channels cch2, cch4, cch6 and the second recessed groove GG2 are formed at the inside of each of the first and second channel blocks 71, 72. The channels are formed by covering the first and second recessed grooves GG1, GG2 with the rubber sheet 73. Therefore, the cross-sectional shape of the channel is variable in the channel, and the variation or fluctuation of the liquid pressure caused by the flow rate change is suppressed.

In the state in which the first channel block 71 and the second channel block 72 are joined, the ink flow ports CP3, CP4 of the first channel block 71 and the ink flow ports CP3, CP4 of the second channel block 72 are aligned in the medium feeding direction at the left end in the medium widthwise direction. Similarly, the ink flow ports CP5, CP6 of the first channel block 71 and the ink flow ports CP5, CP6 of the second channel block 72 are aligned in the medium feeding direction at the right end in the medium widthwise direction.

As depicted in FIG. 12, the channel member 70 is connected to the upper surface of the frame member 50. In this state, the eight ink flow ports CP3 to CP6 of the channel member 70 are communicated with the eight channel-forming through-holes th of the frame member 50 respectively.

<Channel Structure of Head System HS2>

The channels, which are formed by the head system HS2 having the configuration as described above, will be organized with reference to FIG. 14. In this case, it is assumed that a black ink is accommodated in the first subtank ST1, and a yellow ink is accommodated in the second subtank ST2.

The first supply channel $S_1$ for feeding the black ink contained in the first subtank ST1 to the head 60 and the first discharge channel $D_1$ for feeding the black ink contained in the head 60 to the drain tank DT1 are formed by the first channel block 71 of the channel member 70 and the channel-forming through-holes th of the frame member 50.

The ink, which is supplied from the first subtank ST1 via the ink channel member IC2 to the ink flow port (first supply port) CP1 of the first channel block 71, passes through the channel cch1, and the ink arrives at the first recessed groove GG1. The ink is divided into two ink flows at the top portion $GG1_{tp}$ of the first recessed groove GG1.

One flow of the ink after being divided into the two flows passes through the first portion GG11 of the first recessed groove GG1, the channel cch3, the ink flow port CP3, the channel-forming through-hole th of the frame member 50, and the ink flow port $CP_{61}$ of the head 60 disposed on the left side in the medium widthwise direction at the first position as counted from the supply side end portion in the medium feeding direction, and the flow of the ink flows into the manifold M4. The other flow of the ink after being divided into the two flows passes through the second portion GG12 of the first recessed groove GG1, the channel cch5, the ink flow port CP5, the channel-forming through-hole th of the frame member 50, and the ink flow port $CP_{61}$ of the head 60 disposed on the right side in the medium widthwise direction at the second position as counted from the supply side end portion in the medium feeding direction, and the flow of the ink flows into the manifold M3.

The flow of the ink, which passes through the manifold M4 and arrives at the ink flow port $CP_{61}$ positioned on the right side in the medium widthwise direction at the first position as counted from the supply side end portion in the medium feeding direction, passes through the ink flow port CP6 of the first channel block 71, the channel cch6, and the second portion GG22 of the second recessed groove GG2, and the flow of the ink arrives at the top portion $GG2_{tp}$ of the second recessed groove GG2. The flow of the ink, which passes through the manifold M3 and arrives at the ink flow port $CP_{61}$ positioned on the left side in the medium widthwise direction at the second position as counted from the supply side end portion in the medium feeding direction, passes through the ink flow port CP4 of the first channel block 71, the channel cch4, and the first portion GG21 of the second recessed groove GG2, and the flow of the ink arrives at the top portion $GG2_{tp}$ of the second recessed groove GG2. The flows of the ink merge at the top portion $GG2_{tp}$. The ink passes through the channel cch2, the ink flow port (first discharge port) CP2, and the ink channel member IC3, and the ink flows to the drain tank DT1. The ink, which is contained in the first drain tank DT1, is fed to the first subtank ST1 by the first pump PP 1.

The second supply channel S2 for feeding the yellow ink contained in the second subtank ST2 to the head 60 and the second discharge channel D2 for feeding the yellow ink contained in the head 60 to the second drain tank DT2 are formed by the second channel block 72 of the channel member 70 and the channel-forming through-holes th of the frame member 50.

The ink, which is supplied from the second subtank ST2 via the ink channel member IC2 to the ink flow port CP2 (second supply port) of the second channel block 72, passes through the channel cch2, and the ink arrives at the second recessed groove GG2. The ink is divided into two ink flows at the top portion $GG2_{tp}$ of the second recessed groove GG2.

One flow of the ink after being divided into the two flows passes through the first portion GG21 of the second recessed groove GG2, the channel cch4, the ink flow port CP4, the channel-forming through-hole th of the frame member 50, and the ink flow port $CP_{61}$ of the head 60 disposed on the left side in the medium widthwise direction at the third position as counted from the supply side end portion in the medium feeding direction, and the flow of the ink flows into the manifold M2. The other flow of the ink after being divided into the two flows passes through the second portion GG22 of the second recessed groove GG2, the channel cch6, the ink flow port CP6, the channel-forming through-hole th of the frame member 50, and the ink flow port $CP_{61}$ of the head 60 disposed on the right side in the medium widthwise direction at the fourth position as counted from the supply side end portion in the medium feeding direction, and the flow of the ink flows into the manifold M1.

The flow of the ink, which passes through the manifold M2 and arrives at the ink flow port $CP_{61}$ positioned on the right side in the medium widthwise direction at the third position as counted from the supply side end portion in the medium feeding direction, passes through the ink flow port CP5 of the second channel block 72, the channel cch5, and the second portion GG12 of the first recessed groove GG1, and the flow of the ink arrives at the top portion $GG1_{tp}$ of the first recessed groove GG1. The flow of the ink, which passes through the manifold M1 and arrives at the ink flow port $CP_{61}$ positioned on the left side in the medium widthwise direction at the fourth position as counted from the supply side end portion in the medium feeding direction, passes through the ink flow port CP3 of the second channel block 72, the channel cch3, and the first portion GG11 of the first recessed groove GG1, and the flow of the ink arrives at the top portion $GG1_{tp}$ of the first recessed groove GG1. The flows of the ink merge at the top portion $GG1_{tp}$. The ink passes through the channel cch1, the ink flow port CP1 (second discharge port), and the ink channel member IC3, and the ink flows to the drain tank DT2. The ink, which is contained in the second drain tank DT2, is fed to the second subtank ST2 by the second pump PP2.

In this case, the channel, which is included in the first supply channel S1 and which is formed between the ink flow port CP1 (first supply port) of the first channel block 71 and the top portion $GG1_{tp}$ of the first recessed groove GG1, is the common supply channel (first common supply channel) $S1_0$. The channels, which extend from the top portion $GG1_{tp}$ to arrive at the manifolds M4, M3, are the supply branched-channels (first and second supply branched-channels) $S1_1$ respectively.

The first channel block 71 and the frame member 50 may be configured so that the channel resistances of the two supply branched-channels $S1_1$ are identical with each other. Specifically, for example, the first channel block 71 may be configured so that the channel lengths of the two supply branched-channels $S1_1$ are identical with each other, and the cross-sectional areas (cross-sectional areas based on the plane orthogonal to the direction in which the channels extend) of the two supply branched-channels $S1_1$ are identical with each other. Accordingly, the amounts of the ink fed from the top portion $GG1_{tp}$ of the first recessed groove GG1 to the two supply branched-channels $S1_1$ respectively are identical to one another (equal amount branching can be achieved), and it is possible to flow the ink at a stable flow rate. Further, the flow rate of the ink flowing through the manifold M3 is the same as the flow rate of the ink flowing through the manifold M4. Any uneven temperature is more favorably dissolved for the ink flowing through the manifolds M3, M4. Consequently, any uneven density is more favorably dissolved in the image formation.

The first channel block 71 may be configured so that the area (inclined portion) of the first recessed groove GG1, which extends in the direction different from the vertical direction while intersecting the plane (horizontal plane) including the medium widthwise direction and the medium feeding direction, has the channel lengths which is not less than a half of the channel length of the first supply channel S1.

The channel, which is included in the first discharge channel D1 and which is formed between the ink flow port CP2 (first discharge port) of the first channel block 71 and the top portion $GG2_{tp}$ of the second recessed groove GG2, is the common discharge channel (first common discharge channel) $D1_0$. The channels, which extend from the top portion $GG2_{tp}$ to arrive at the manifolds M4, M3, are the discharge branched-channels (first and second discharge branched-channels) $D1_1$ respectively.

The first channel block 71 and the frame member 50 may be configured so that the channel resistances of the two discharge branched-channels $D1_1$ are identical with each other. Specifically, for example, the first channel block 71 may be configured so that the channel lengths of the two discharge branched-channels $D1_1$ are identical with each other, and the cross-sectional areas (cross-sectional areas based on the plane orthogonal to the direction in which the channels extend) of the two discharge branched-channels $D1_1$ are identical with each other. Accordingly, the amounts of the ink fed from the two discharge branched-channels D respectively toward the top portion $GG2_{tp}$ of the second recessed groove GG2 are identical to one another (equal amount branching can be achieved), and it is possible to flow the ink at a stable flow rate. Further, the flow rate of the ink flowing through the manifold M3 is the same as the flow rate of the ink flowing through the manifold M4. Any uneven temperature is more favorably dissolved for the ink flowing through the manifolds M3, M4. Consequently, any uneven density is more favorably dissolved in the image formation.

The first channel block 71 may be configured so that the area (inclined portion) of the second recessed groove GG2, which extends in the direction different from the vertical direction while intersecting the plane (horizontal plane) including the medium widthwise direction and the medium feeding direction, has the channel lengths which is not less than a half of the channel length of the first discharge channel D1.

The channel, which is included in the second supply channel S2 and which is formed between the ink flow port CP2 (second supply port) of the second channel block 72 and the top portion $GG2_{tp}$ of the second recessed groove GG2, is the common supply channel (second common supply channel) $S2_0$. The channels, which extend from the top portion $GG2_{tp}$ to the manifolds M2, M1, are the supply branched-channels S21 respectively.

The channel, which is included in the second discharge channel D2 and which is formed between the ink flow port CP1 (second discharge port) of the second channel block 72 and the top portion $GG1_{tp}$ of the first recessed groove GG1, is the common discharge channel (second common discharge channel) $D2_0$. The channels, which extend from the top portion $GG1_{tp}$ to the manifolds M2, M1, are the discharge branched-channels $D2_1$ respectively.

The first channel block 71 and the second channel block 72 may be configured so that the channel resistance of the first supply channel S1 is the same as the channel resistance of the second supply channel S2. The first channel block 71 and the second channel block 72 may be configured so that the channel resistance of the first discharge channel D1 is the same as the channel resistance of the second discharge channel D2. Accordingly, the ink channels of the two routes, which are independent from each other, can be regarded as the channels having substantially the same quality (same property). Therefore, the difference in the flow rate is hardly caused between the both channels. It is possible to more favorably suppress the deterioration of the quality of the image.

In this embodiment, for example, if the error of the channel resistance of one of the two supply branched-channels $S1_1$ with respect to the channel resistance of the other of the two supply branched-channels $S1_1$ is within 10% of the channel resistance of the other of the two supply branched-channels $S1_1$, then it is possible to realize the equal amount branching, and it is possible to favorably suppress the uneven density upon the image formation. Similarly, if the error of the channel resistance of one of the two discharge branched-channels $D1_1$ with respect to the channel resistance of the other of the two discharge branched-channels $D1_1$ is within 10% of the channel resistance of the other of the two discharge branched-channels $D1_1$, then it is possible to realize the equal amount branching, and it is possible to favorably suppress the uneven density upon the image formation. Further, if the error of the channel resistance of the first supply channel S1 with respect to the channel resistance of the second supply channel S2 is within 10% of the channel resistance of the second supply channel S2, then the difference in the flow rate is hardly caused between the both channels, and it is possible to more favorably suppress the deterioration of the quality of the image.

As described above in relation to this specification and the present disclosure, also in this embodiment and the modified embodiment thereof, the phrase "the channel resistance of a certain channel is the same as (identical to) the channel resistance of another channel" means that the error of the channel resistance of the certain channel with respect to the channel resistance of the another channel is within 10% of the channel resistance of the another channel. The phrase "the cross-sectional area of a certain channel is the same as (identical to) the cross-sectional area of another channel" means that the error of the cross-sectional area of the certain channel with respect to the cross-sectional area of the another channel is less than 10% of the cross-sectional area of the another channel. The phrase "the channel length of a certain channel is the same as (identical to) the channel length of another channel" means that the error of the channel length of the certain channel with respect to the channel length of the another channel is less than 10% of the channel length of the another channel. Note that when the cross-sectional area of a certain channel is compared with the cross-sectional area of another channel, if the cross-sectional area is not constant in the entire region of the channel, then it is possible to use an average value of the cross-sectional areas in the entire region of the channel. Further, the phrase "the flow rate of the liquid flowing through a certain channel is the same as (identical to) the flow rate of the liquid flowing through another channel" means that the error of the flow rate of the liquid flowing through the certain channel with respect to the flow rate of the liquid flowing through the another channel is within 10% of the flow rate of the liquid flowing through the another channel.

The directions, in which the ink flows through the first and second supply channels S1, S2, the manifolds M1 to M4, and the first and second discharge channels D1, D2, are as indicated by the arrows in FIG. 14. As depicted in FIG. 14, as for the head system HS2 of this embodiment, the ink flows toward the left side in the medium widthwise direction in the manifolds M1, M3, and the ink flows toward the right side in the medium widthwise direction in the manifolds M2, M4. Accordingly, the deterioration of the quality of the image is suppressed in accordance with the same or equivalent mechanism as that of the head system HS1 of the first embodiment.

The effect of the head system HS2 of the second embodiment will be summarized below.

The supply channels S1, S2 and the discharge channels D1, D2 of the head system HS2 of the second embodiment have a configuration for supplying and discharging the ink with respect to the manifolds of the head 60 which are arranged adjacently to one another in the medium feeding direction, so that the orientations (directions) of the flows of the ink in those manifolds are opposite to one another. Therefore, the uneven densities, which may be caused in the images formed by the nozzle arrays $L_3$ corresponding to the respective manifolds, can be offset between the manifolds adjacent to one another in the medium feeding direction (between the nozzle arrays adjacent to one another in the medium feeding direction). It is possible to suppress the deterioration of the quality of the image to be formed.

In the head system HS2 of the second embodiment, any one of the manifolds M1 to M4 of the head 60 has the linear or straight shape which extends in the medium widthwise direction. Therefore, the channel length is short as compared with, for example, a manifold which has a U-shaped form in a plan view, which extends from an ink supply port (upstream end) to one side in the medium widthwise direction, and which thereafter turns to extend to the ink discharge side (downstream side). Therefore, the difference is small between the temperature of the ink supplied to the pressure chamber connected to the vicinity of the upstream end of the manifold and the temperature of the ink supplied to the pressure chamber connected to the vicinity of the downstream end of the manifold. The deterioration of the image quality, which depends on the temperature change of the ink, is suppressed.

The head system HS2 of the second embodiment is provided with the supply channel S1 and the supply channel S2 which are separated from each other in the entire region ranging from the ink supply port to the head, and the discharge channel D1 and the discharge channel D2 which are separated from each other in the entire region ranging from the head to the ink discharge port. Therefore, the inks of the two different types can be flown through the single head.

In the head system HS2 of the second embodiment, the greater parts of the supply channel S1 and the discharge channel D1 are formed by the integrated or monolithic channel block 71, and the greater parts of the supply channel S2 and the discharge channel D2 are formed by the integrated or monolithic channel block 72. Further, the channel block 71 and the channel block 72 are joined into one unit which is arranged over or above the head 60. Accordingly, the channels can be efficiently arranged in the limited space disposed over or above the head 60, and it is possible to miniaturize the head system HS2. Further, it is possible to enhance the durability of the channel against the ink by forming the channel with, for example, POM or the like.

The ink supply system ISS2, the printing apparatus 1000, and the ink flow method of the second embodiment also provide the same or equivalent effect as that of the head system HS2.

Modified Embodiment 2-1

Next, an explanation will be made with reference to FIG. 15 about an ink supply system ISS2' of a modified embodiment 2-1.

Also in the ink supply system ISS2' of the modified embodiment 2-1, a second supply channel ST for feeding the yellow ink contained in the second subtank ST2 to the head 60 and a second discharge channel D2' for feeding the yellow ink contained in the head 60 to the second drain tank DT2 are formed by the second channel block 72 of the channel member 70 and the channel-forming through-holes th of the frame member 50, in the same manner as the ink supply system ISS2 of the second embodiment. However, the direction of the flow of the ink in the second channel block 72 is opposite to that of the ink supply system ISS2 of the second embodiment.

Figure 15:
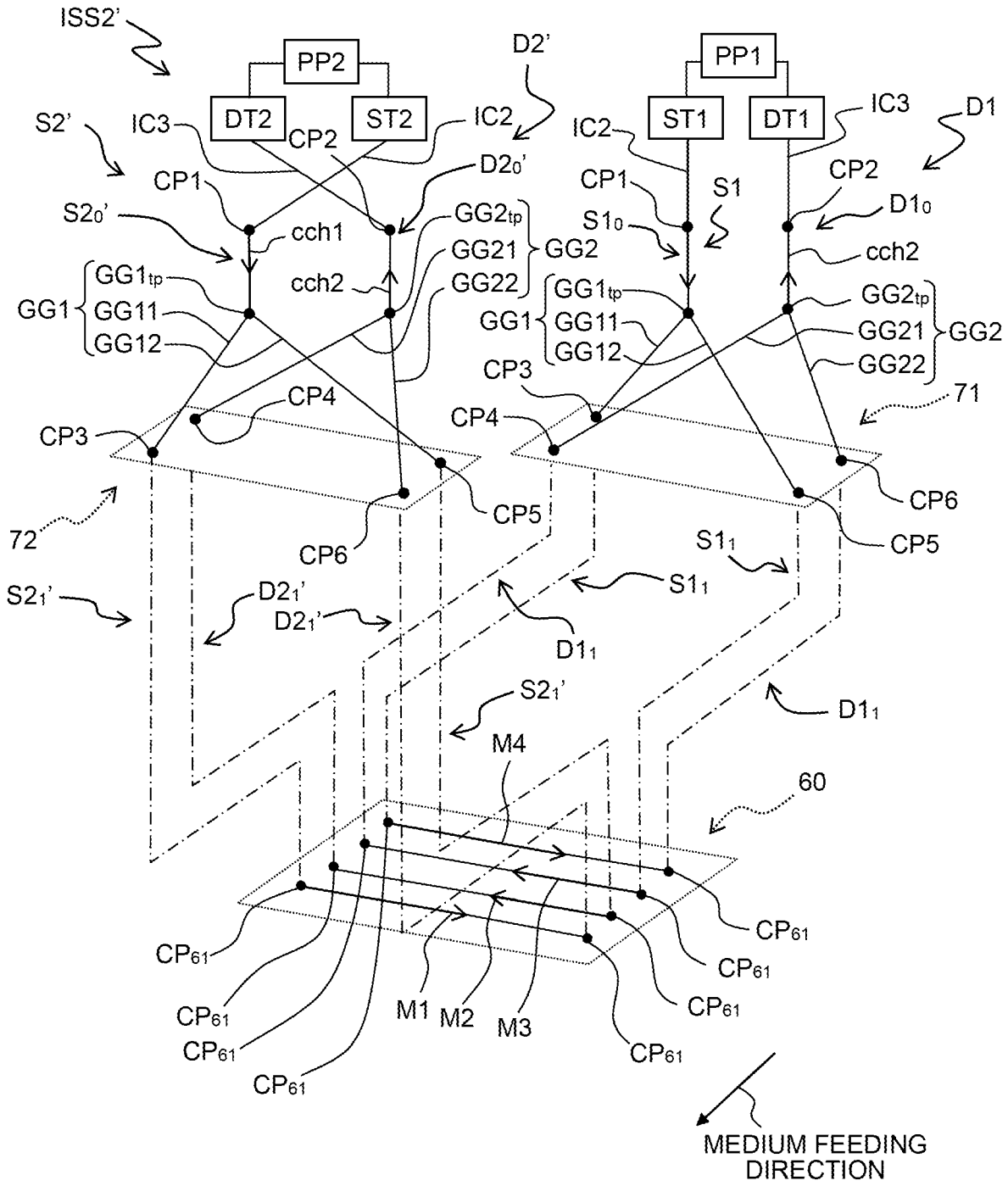
FIG. 15 is an explanatory drawing depicting channels formed by an ink supply system according to a modified embodiment 2-1.

As depicted in FIG. 15, in the ink supply system ISS2' of the modified embodiment 2-1, the second subtank ST2 and the ink flow port CP1 of the second channel block 72 are connected by the ink channel member IC2, and the second drain tank DT2 and the ink flow port CP2 of the second channel block 72 are connected by the ink channel member IC3.

The ink, which is supplied from the second subtank ST2 via the ink channel member IC2 to the ink flow port CP1 (second supply port) of the second channel block 72, passes through the channel cch1 and arrives at the first recessed groove GG1. The ink is divided into two ink flows at the top portion $GG1_{tp}$ of the first recessed groove GG1.

One flow of the ink after being divided into the two flows passes through the first portion GG11 of the first recessed groove GG1, the channel cch3, and the ink flow port CP3, and the flow of the ink flows into the manifold M1 from the left side in the medium widthwise direction. The other flow of the ink after being divided into the two flows passes through the second portion GG12 of the first recessed groove GG1, the channel cch5, and the ink flow port CP5, and the flow of the ink flows into the manifold M2 from the right side in the medium widthwise direction.

The ink, which passes through the manifold M1 and arrives at the ink flow port CP6 of the second channel block 72, passes through the second portion GG22 of the second recessed groove GG2 and arrives at the top portion $GG2_{tp}$ of the second recessed groove GG2. The ink, which passes through the manifold M2 and arrives at the ink flow port CP4 of the second channel block 72, passes through the first portion GG21 of the second recessed groove GG2 and arrives at the top portion $GG2_{tp}$ of the second recessed groove GG2. The flows of the ink merge at the top portion $GG2_{tp}$. The ink passes through the channel cch2, the ink flow port CP2 (second discharge port), and the ink channel member IC3, and the ink flows to the drain tank DT2.

The channel, which is included in the second supply channel ST and which is formed between the ink flow port CP1 (second supply port) of the second channel block 72 and the top portion $GG1_{tp}$ of the first recessed groove GG1, is the common supply channel (second common supply channel) $S2_0'$, and the channels, which extend from the top portion $GG1_{tp}$ to arrive at the manifolds M2, M1, are the supply branched-channels $S2_1'$ respectively.

The channel, which is included in the second discharge channel D2' and which is formed between the ink flow port CP2 (second discharge port) of the second channel block 72 and the top portion $GG2_{tp}$ of the second recessed groove GG2, is the common discharge channel (second common discharge channel) $D2_0'$, and the channels, which extend from the top portion $GG2_{tp}$ to arrive at the manifolds M2, M1, are the discharge branched-channels $D2_1'$ respectively.

In the ink supply system ISS2' of the modified embodiment 2-1, as depicted in FIG. 15, the ink flows toward the right side in the medium widthwise direction in the manifolds M1, M4, and the ink flows toward the left side in the medium widthwise direction in the manifolds M2, M3. The uneven densities are offset (averaged) between the manifold M1 and the manifold M2, and between the manifold M3 and the manifold M4. The image to be formed is suppressed from the deterioration of the quality.

Note that in the ink supply system ISS2 of the second embodiment, the first subtank ST1 and the ink flow port CP2 of the first channel block 71 may be connected by using the ink channel member IC2, and the first drain tank DT1 and the ink flow port CP1 of the first channel block 71 may be connected by using the ink channel member IC3. In this case, the ink flows toward the left side in the medium widthwise direction in the manifolds M1, M4, and the ink flows toward the right side in the medium widthwise direction in the manifolds M2, M3.

Modified Embodiment 2-2

Figure 16:
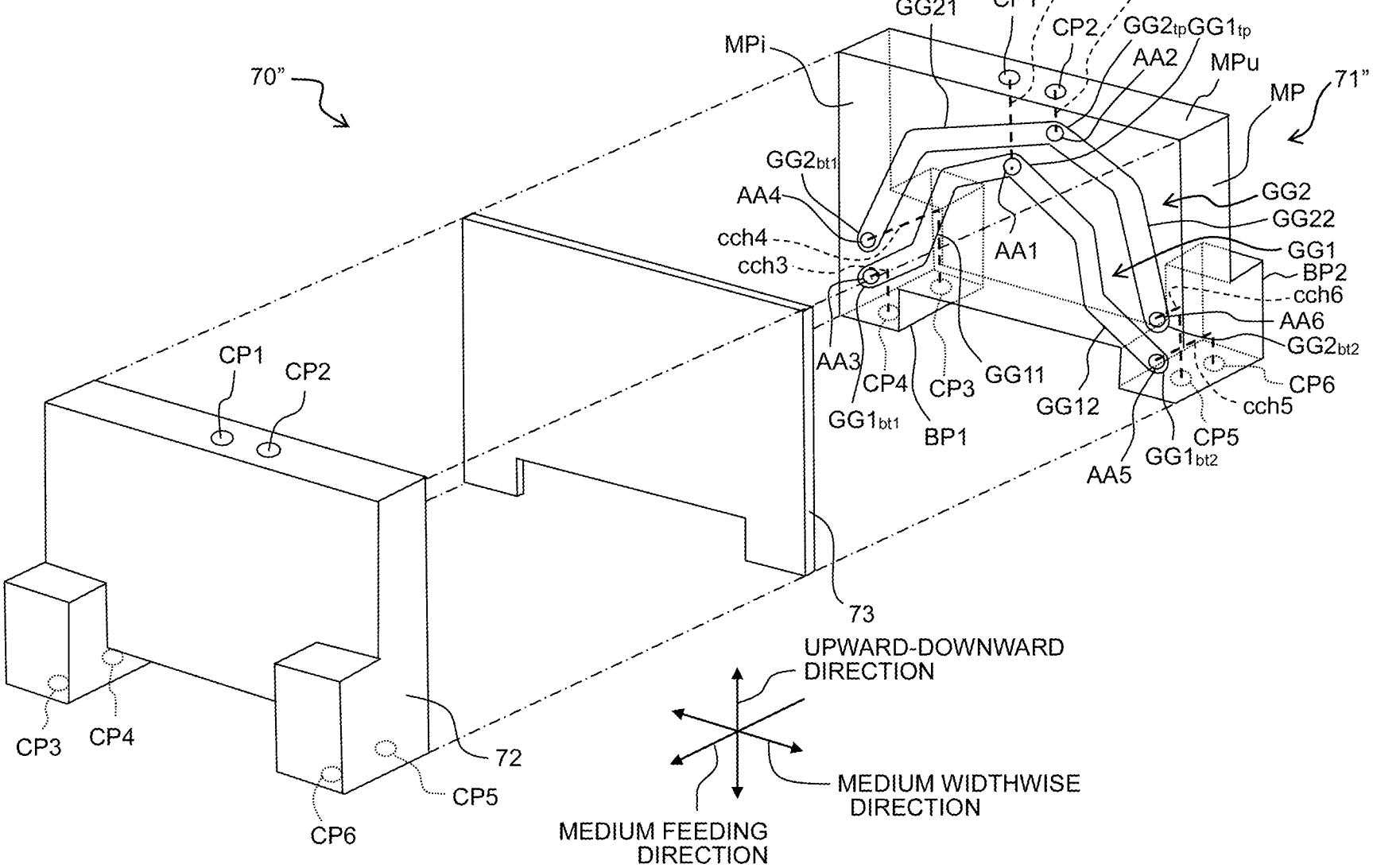
FIG. 16 is an exploded perspective view depicting a channel member according to a modified embodiment 2-2.

Next, an explanation will be made with reference to FIGS. 16 and 17 about an ink supply system ISS2" of a modified embodiment 2-2.

In the ink supply system ISS2" of the modified embodiment 2-2, a channel block 70" is used in place of the channel block 70 provided for the ink supply system ISS2 of the second embodiment. The other features are the same as those of the ink supply system ISS2 of the second embodiment, any explanation of which will be omitted.

The channel block 70" is different from the channel block 70 of the second embodiment in that the channel block 70" is provided with a first channel block 71" in place of the first channel block 71.

In the first channel block 71", the configuration of the channel cch3 to the channel cch6 is different from the configuration of the channel cch3 to the channel cch6 of the first channel block 71.

Specifically, the upper end portion of the channel cch3 is communicated with the first recessed groove GG1 via an opening AA3 formed at the lower end portion $GG1_{bt1}$ of the first recessed groove GG1. The channel cch3 extends from the upper end portion to the supply side in the medium feeding direction, and then the channel cch3 is bent downwardly to extend to the ink flow port CP4. The upper end portion of the channel cch4 is communicated with the second recessed groove GG2 via an opening AA4 formed at the lower end portion $GG2_{bt1}$ of the second recessed groove GG2. The channel cch4 extends from the upper end portion to the supply side in the medium feeding direction, and then the channel cch4 is bent downwardly to extend to the ink flow port CP3. As depicted in FIG. 16, as for the channel length of the area extending horizontally toward the supply side in the medium feeding direction, the channel length concerning the channel cch4 is longer than the channel length concerning the channel cch3.

The upper end portion of the channel cch5 is communicated with the first recessed groove GG1 via an opening AA5 formed at the lower end portion $GG1_{bt2}$ of the first recessed groove GG1. The channel cch5 extends from the upper end portion to the supply side in the medium feeding direction, and then the channel cch5 is bent downwardly to extend to the ink flow port CP6. The upper end portion of the channel cch6 is communicated with the second recessed groove GG2 via an opening AA6 formed at the lower end portion $GG2_{bt2}$ of the second recessed groove GG2. The channel cch6 extends from the upper end portion to the supply side in the medium feeding direction, and then the channel cch6 is bent downwardly to pass by the channel cch5 and extend to the ink flow port CP5. As depicted in FIG. 16, as for the channel length of the area extending horizontally toward the supply side in the medium feeding direction, the channel length concerning the channel cch5 is longer than the channel length concerning the channel cch6. Further, as for the channel length of the area extending horizontally toward the supply side in the medium feeding direction, the channel length concerning the channel cch3 and the channel length concerning the channel cch6 are equal to one another, and the channel length concerning the channel cch4 and the channel length concerning the channel cch5 are equal to one another.

In the first channel block 71", the channel length of the channel between the opening AA1 and the ink flow port CP4 is shorter than the channel length of the channel between the opening AA1 and the ink flow port CP6. Therefore, the cross-sectional area of the channel between the opening AA1 and the ink flow port CP6 is larger than the cross-sectional area of the channel between the opening AA1 and the ink flow port CP4 so that the channel resistances of the both channels are equal to one another. Note that the channel length of the channel between the opening AA1 and the ink flow port CP4 and the channel length of the channel between the opening AA1 and the ink flow port CP6 may be equal to one another by changing the number of times of the bending of the first recessed groove GG11 and/or the number of times of the bending of the second recessed groove GG12 and/or shifting the position of the top portion $GG1_{tp}$ in the medium widthwise direction. In this case, the cross-sectional areas of the both channels may be equal to one another.

Similarly, in the first channel block 71", the channel length of the channel between the opening AA2 and the ink flow port CP5 is shorter than the channel length of the channel between the opening AA2 and the ink flow port CP3. Therefore, the cross-sectional area of the channel between the opening AA2 and the ink flow port CP3 is larger than the cross-sectional area of the channel between the opening AA2 and the ink flow port CP5 so that the channel resistances of the both channels are equal to one another.

The ink supply system ISS2" of the modified embodiment 2-2 is provided with the channel block 70" in place of the channel block 70, and thus the supply channel S1" and the discharge channel D1" (FIG. 17) are configured in place of the supply channel S1 and the discharge channel D1.

Figure 17:
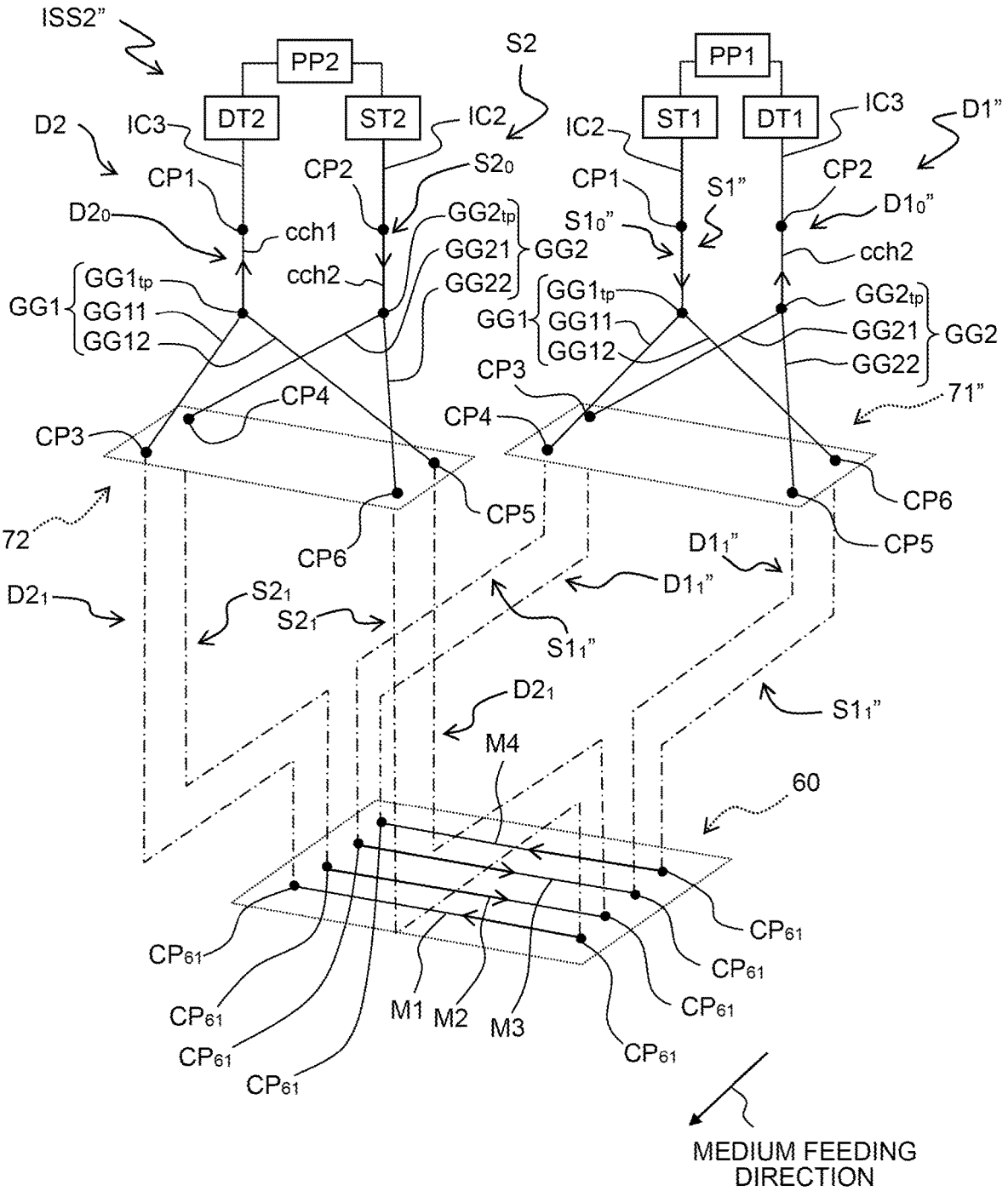
FIG. 17 is an explanatory drawing depicting channels formed by an ink supply system according to the modified embodiment 2-2.

Specifically, as depicted in FIG. 17, the ink, which is supplied from the first subtank ST1 via the ink channel member IC2 to the ink flow port (first supply port) CP1 of the first channel block 71", passes through the channel cch1, and the ink arrives at the first recessed groove GG1. The ink is divided into two ink flows at the top portion $GG1_{tp}$ of the first recessed groove GG1.

One flow of the ink after being divided into the two flows passes through the first portion GG11 of the first recessed groove GG1, the channel cch3, and the ink flow port CP4, and the flow of the ink flows into the manifold M3 from the left side in the medium widthwise direction. The other flow of the ink after being divided into the two flows passes through the second portion GG12 of the first recessed groove GG1, the channel cch5, and the ink flow port CP6, and the flow of the ink flows into the manifold M4 from the right side in the medium widthwise direction.

The flow of the ink, which flows in the right orientation (direction) through the manifold M3 and which thereafter inflows from the ink flow port CP5 of the first channel block 71", passes through the channel cch6 and the second portion GG22 of the second recessed groove GG2, and the flow of the ink arrives at the top portion $GG2_{tp}$ of the second recessed groove GG2. The flow of the ink, which flows in the left orientation (direction) through the manifold M4 and which thereafter inflows from the ink flow port CP3 of the first channel block 71", passes through the channel cch4 and the first portion GG21 of the second recessed groove GG2, and the flow of the ink arrives at the top portion $GG2_{tp}$ of the second recessed groove GG2. The flows of the ink merge at the top portion $GG2_{tp}$. The ink passes through the channel cch2, the ink flow port (first discharge port) CP2, and the ink channel member IC3, and the ink flows to the drain tank DT1. The ink, which is contained in the first drain tank DT1, is fed to the first subtank ST1 by the first pump PP 1.

In this case, the channel, which is included in the first supply channel S1" and which is formed between the ink flow port CP1 (first supply port) of the first channel block 71" and the top portion $GG1_{tp}$ of the first recessed groove GG1, is the common supply channel (first common supply channel) $S1_0$". The channels, which extend from the top portion $GG1_{tp}$ to arrive at the manifolds M4, M3, are the supply branched-channels (first and second supply branched-channels) $S1_1$" respectively. The channel, which is included in the first discharge channel D1" and which is formed between the ink flow port CP2 (first discharge port) of the first channel block 71" and the top portion $GG2_{tp}$ of the second recessed groove GG2, is the common discharge channel (first common discharge channel) $D1_0$". The channels, which extend from the top portion $GG2_{tp}$ to arrive at the manifolds M4, M3, are the discharge branched-channels (first and second discharge branched-channels) $D1_1$" respectively.

In the ink supply system ISS2" of the modified embodiment 2-2, as depicted in FIG. 17, the ink flows toward the left side in the medium widthwise direction in the manifolds M1, M4, and the ink flows toward the right side in the medium widthwise direction in the manifolds M2, M3. The uneven densities are offset (averaged) between the manifold M1 and the manifold M2, and between the manifold M3 and the manifold M4. The deterioration of the quality of the image to be formed is suppressed.

Note that in the ink supply system ISS2 of the second embodiment, the second channel block 72 of the channel block 70 may be modified in the same manner as the first channel block 71" described above (i.e., the second channel block 72 of the channel block 70 may be modified so that the second channel block 72 is in mirror symmetry with respect to the first channel block 71" on the basis of the plane orthogonal to the medium feeding direction). In this case, the ink flows toward the right side in the medium widthwise direction in the manifolds M1, M4, and the ink flows toward the left side in the medium widthwise direction in the manifolds M2, M3.

The following modified modes can be also used in the head system HS2 of the second embodiment, the head system provided for the ink supply system ISS' of the modified embodiment 2-1, and the head system provided for the ink supply system ISS" of the modified embodiment 2-2. The respective modified modes described below are described in relation to the head system HS2 of the second embodiment. However, the same or equivalent modifications may be used for the head systems of the respective modified embodiments.

The head system HS2 of the second embodiment is provided with the supply/discharge channels of the two route, i.e., the supply channels S1, S2 and the discharge channels D1, D2. However, there is no limitation thereto. The head system HS2 may be configured such that the head system HS2 is provided with only the supply channel S1 and the discharge channel D1, or the head system HS2 is provided with only the supply channel S2 and the discharge channel D2. Alternatively, the same ink may be circulated through the supply channels S1, S2 and the discharge channels D1, D2 to use the channels as the supply/discharge channels of substantially one route.

In the head system HS2 of the second embodiment, the supply channels S1, S2 and the discharge channels D1, D2 are configured by the channel member 70. However, there is no limitation thereto. The supply channels S1, S2 and the discharge channels D1, D2 may be configured by using tubular members such as tubes made of resin or the like.

In the head system HS2 of the second embodiment, any material other than rubber may be used in place of the rubber sheet 73. It is possible to use an arbitrary material which can form the channel by giving the covers to the first and second recessed grooves GG1, GG2 of the first and second channel blocks 71, 72. It is more preferable to use a material which further provides the function (damper function) to suppress, by the deformation, the liquid pressure fluctuation caused by the flow rate change. It is desirable to form the sheet with a material softer than the material for forming the first channel block 71 and the second channel block 72. However, there is no limitation thereto. It is also possible to form the channels by covering the first and second recessed grooves GG1, GG2 by using a material, such as resin and metal etc., having smaller deflection as compared with rubber.

The embodiments and the modified embodiments have been explained above by using the examples of the cases in which the image is formed on the medium PM by discharging the ink from the head system HS1, HS2. The head systems HS1, HS2 may be a liquid discharge system for discharging an arbitrary liquid in order to form an image. The medium PM, on which the image is to be formed, may be, for example, recording paper, cloth, or resin. Further, the head systems HS1, HS2 may be used as a head system for a serial head type printer.

Figure 18:
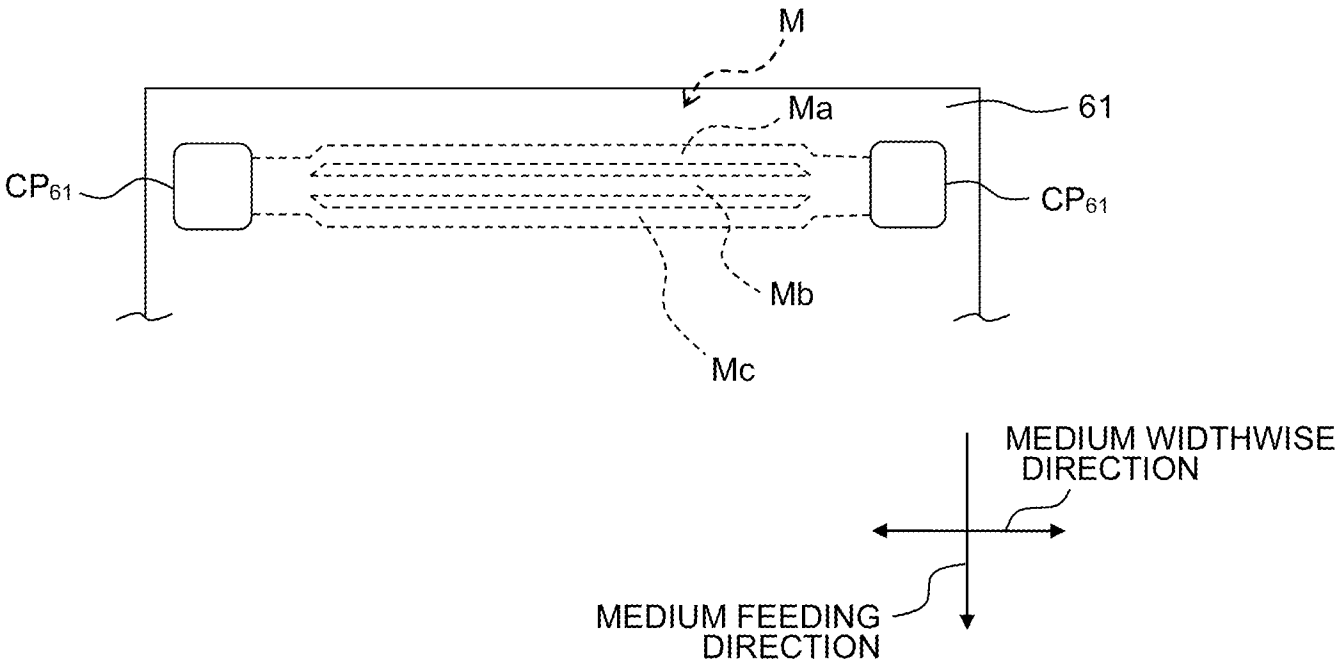
FIG. 18 is a plan view depicting a modified mode of a manifold.

Further, in the head systems HS1, HS2 and in the respective modified embodiments, at least one of the manifolds M1 to M4 may be branched in the medium feeding direction at least at a part of the area disposed between the both end portions, as in a manifold M depicted in FIG. 18.

The manifold M depicted in FIG. 18 is branched into three small manifolds Ma, Mb, Mc separated from each other in the medium feeding direction, between the vicinity of the left end and the vicinity of the right end in the medium widthwise direction. The small manifolds Ma, Mb, Mc are parallel to one another. A plurality of individual channels (not depicted), which are aligned in the medium widthwise direction, are connected to each of the small manifolds Ma, Mb, Mc. Nozzle arrays are constructed by the plurality of individual channels. Three small manifolds Ma to Mc behave as substantially one (single) manifold in relation to the suppression of the deterioration of the image quality on the basis of the mechanism of the present disclosure.

It is to be considered that the embodiments described in this specification are described by way of example in all viewpoints, which do not limit the present invention. For example, the number of the head units 100 and the configuration thereof may be changed. The number of the colors capable of being simultaneously printed by the printing apparatus 1000 is not limited as well. It is also allowable to adopt such configuration that only the single color printing can be performed. Further, for example, it is also possible to appropriately change the number and the arrangement of the individual channels ICH. Further, the technical features described in the respective embodiments can be combined with each other.

The present invention is not limited to the embodiments described above provided that the features of the present invention are maintained. Any other form, which may be conceived within a range of the technical concept of the present invention, is also included in the scope of the present invention.

According to the head system, the liquid supply system, the printing apparatus, and the liquid flow method of the above embodiments, it is possible to suppress any deterioration of the image quality which would be otherwise caused by the temperature change of the liquid.

What is claimed is:

1. A head system comprising:

a head;

a supply channel which has a supply port configured to receive a liquid, and which extends between the supply port and the head; and a discharge channel which has a discharge port configured to discharge the liquid and which extends between the discharge port and the head, wherein:

the head has four groups each including a manifold extending in a first direction and a plurality of pressure chambers each connected to the manifold and a nozzle;

the four groups include a first group, a second group, a third group and a fourth group arranged in an order of the first group, the second group, the third group, and the fourth group in a second direction orthogonal to the first direction, the second group being arranged between the first group and the third group in the second direction, the third group being arranged between the second group and the fourth group in the second direction, the second group and the third group being arranged between the first group and the fourth group in the second direction;

one end of the manifold included in each of the four groups is positioned on a first side in the first direction, and an opposite end of the manifold included in each of the four groups is positioned on a second side in the first direction;

the supply channel is connected to the one end of the manifold included in each of two groups of the four groups and is connected to the opposite end of the manifold included in each of remaining two groups of the four groups, the two groups constituting a group A and the remaining two groups constituting a group B;

the discharge channel is connected to the opposite end of the manifold included in each of the two groups constituting the group A and is connected to the one end of the manifold included in each of the two groups constituting the group B; and the first group and the third group constitute the group A and the second group and the fourth group constitute the group B, or the first group and the fourth group constitute the group A and the second group and the third group constitute the group B.

2. The head system according to claim 1, wherein the first group and the third group constitute the group A and the second group and the fourth group constitute the group B.

3. The head system according to claim 1, wherein the first group and the fourth group constitute the group A and the second group and the third group constitute the group B.

4. The head system according to claim 1, wherein:

the supply channel includes a common supply channel, a first supply branched-channel, and a second supply branched-channel;

the common supply channel has an upstream end connected to the supply port;

the first supply branched-channel has an upstream end connected to a downstream end of the common supply channel and a downstream end connected to the one end of the manifold included in each of the two groups constituting the group A;

the second supply branched-channel has an upstream end connected to the downstream end of the common supply channel and a downstream end connected to the opposite end of the manifold included in each of the two groups constituting the group B; and a channel resistance of the first supply branched-channel and a channel resistance of the second supply branched-channel are identical to each other.

5. The head system according to claim 4, wherein:

a channel length of the first supply branched-channel and a channel length of the second supply branched-channel are identical to each other; and a cross-sectional area of the first supply branched-channel and a cross-sectional area of the second supply branched-channel are identical to each other.

6. The head system according to claim 4, wherein:

the first supply branched-channel includes:

a first common supply branched-channel which has an upstream end connected to the downstream end of the common supply channel;

a first branched supply branched-channel which has an upstream end connected to a downstream end of the first common supply branched-channel and a downstream end connected to the one end of the manifold included in one of the two groups constituting the group A; and a third branched supply branched-channel which has an upstream end connected to the downstream end of the first common supply branched-channel and a downstream end connected to the one end of the manifold included in remaining one of the two groups constituting the group A, and the second supply branched-channel includes:

a second common supply branched-channel which has an upstream end connected to the downstream end of the common supply channel;

a second branched supply branched-channel which has an upstream end connected to a downstream end of the second common supply branched-channel and a downstream end connected to the opposite end of the manifold included in one of the two groups constituting the group B; and a fourth branched supply branched-channel which has an upstream end connected to the downstream end of the second common supply branched-channel and a downstream end connected to the opposite end of the manifold included in remaining one of the two groups constituting the group B.

7. The head system according to claim 6, wherein each of the first branched supply branched-channel, the second branched supply branched-channel, the third branched supply branched-channel, the fourth branched supply branched-channel has an inclined portion extending in a direction which intersects a plane including the first direction and the second direction and which is different from a vertical direction, and the inclined portion is an area which is not less than a half of each of the first branched supply branched-channel, the second branched supply branched-channel, the third branched supply branched-channel, the fourth branched supply branched-channel.

8. The head system according to claim 7, wherein the inclined portion of the first branched supply branched-channel and the inclined portion of the third branched supply branched-channel are inclined so that the inclined portions make approach to one another at positions nearer to the upstream end of the first branched supply branched-channel and the upstream end of the third branched supply branched-channel, and the inclined portion of the second branched supply branched-channel and the inclined portion of the fourth branched supply branched-channel are inclined so that the inclined portions make approach to one another at positions nearer to the upstream end of the second branched supply branched-channel and the upstream end of the fourth branched supply branched-channel.

9. The head system according to claim 1, wherein:

the discharge channel includes a common discharge channel, a first discharge branched-channel, and a second discharge branched-channel;

the common discharge channel has a downstream end connected to the discharge port;

the first discharge branched-channel has a downstream end connected to an upstream end of the common discharge channel, and an upstream end connected to the opposite end of the manifold included in each of the two groups constituting the group A;

the second discharge branched-channel has a downstream end connected to the upstream end of the common discharge channel, and an upstream end connected to the one end of the manifold included in each of the two groups constituting the group B; and a channel resistance of the first discharge branched-channel and a channel resistance of the second discharge branched-channel are identical to each other.

10. The head system according to claim 9, wherein:

a channel length of the first discharge branched-channel and a channel length of the second discharge branched-channel are identical to each other; and a cross-sectional area of the first discharge branched-channel and a cross-sectional area of the second discharge branched-channel are identical to each other.

11. The head system according to claim 9, wherein:

the first discharge branched-channel includes:

a first common discharge branched-channel which has a downstream end connected to the upstream end of the common discharge channel;

a first branched discharge branched-channel which has a downstream end connected to an upstream end of the first common discharge branched-channel and an upstream end connected to the opposite end of the manifold included in one of the two groups constituting the group A; and a third branched discharge branched-channel which has a downstream end connected to the upstream end of the first common discharge branched-channel and an upstream end connected to the opposite end of the manifold included in remaining one of the two groups constituting the group A; and the second discharge branched-channel includes:

a second common discharge branched-channel which has a downstream end connected to the upstream end of the common discharge channel;

a second branched discharge branched-channel which has a downstream end connected to the upstream end of the second common discharge branched-channel, and an upstream end connected to the one end of the manifold included in one of the two groups constituting the group B; and a fourth branched discharge branched-channel which has a downstream end connected to the upstream end of the second common discharge branched-channel and an upstream end connected to the one end of the manifold included in remaining one of the two groups constituting the group B.

12. The head system according to claim 11, wherein each of the first branched discharge branched-channel, the second branched discharge branched-channel, the third branched discharge branched-channel, the fourth branched discharge branched-channel has an inclined portion extending in a direction which intersects a plane including the first direction and the second direction and which is different from a vertical direction, and the inclined portion is an area which is not less than a half of each of the first branched discharge branched-channel, the second branched discharge branched-channel, the third branched discharge branched-channel, the fourth branched discharge branched-channel.

13. The head system according to claim 12, wherein the inclined portion of the first branched discharge branched-channel and the inclined portion of the third branched discharge branched-channel are inclined so that the inclined portions make approach to one another at positions nearer to the downstream end of the first branched discharge branched-channel and the downstream end of the third branched discharge branched-channel, and the inclined portion of the second branched discharge branched-channel and the inclined portion of the fourth branched discharge branched-channel are inclined so that the inclined portions make approach to one another at positions nearer to the downstream end of the second branched discharge branched-channel and the downstream end of the fourth branched discharge branched-channel.

14. The head system according to claim 1, comprising:

a first channel block positioned on the first side in the first direction; and a second channel block positioned on the second side in the first direction, wherein an area, of the supply channel, which is connected to the one end of the manifold included in each of the two groups constituting the group A, is formed in the first channel block; and wherein an area, of the supply channel, which is connected to the opposite end of the manifold included in each of the two groups constituting the group B, is formed in the second channel block.

15. The head system according to claim 1, comprising:

a first channel block positioned on the first side in the first direction; and a second channel block positioned on the second side in the first direction, wherein an area, of the discharge channel, which is connected to the one end of the manifold included in each of the two groups constituting the group B, is formed in the first channel block; and wherein an area, of the discharge channel, which is connected to the opposite end of the manifold included in each of the two groups constituting the group A, is formed in the second channel block.

16. The head system according to claim 1, comprising:

a first channel block positioned on the first side in the first direction; and a second channel block positioned on the second side in the first direction, wherein an area, of the supply channel, which is connected to the one end of the manifold included in each of the two groups constituting the group A, and an area, of the discharge channel, which is connected to the one end of the manifold included in each of the two groups constituting the group B, is formed in the first channel block; and wherein an area, of the supply channel, which is connected to the opposite end of the manifold included in each of the two groups constituting the group B, and an area, of the discharge channel, which is connected to the opposite end of the manifold included in each of the two groups constituting the group A, is formed in the second channel block.

17. The head system according to claim 1, wherein:

the supply port is a single supply port; and the supply channel extends between the single supply port and each of the four groups of the head.

18. The head system according to claim 1, wherein the plurality of pressure chambers included in a certain group of the first to fourth groups is configured such that the liquid via the manifold included in the certain group of the first to fourth groups is solely supplied to the plurality of pressure chambers.

19. The head system according to claim 1, wherein the manifolds included in the first to fourth groups are provided at mutually identical positions in an upward-downward direction.

20. The head system according to claim 1, wherein a number of the manifolds included in the group A is equal to a number of the manifolds included in the group B.

21. The head system according to claim 1, wherein the manifold, included in at least one of the four groups, is branched into a plurality of channels separated from each other in the second direction, at least at a portion of an area between the one end and the opposite end.

22. A liquid supply system comprising:

the head system as defined in claim 1;

a supply tank connected to the supply channel;

a discharge tank connected to the discharge channel; and a differential pressure mechanism configured to generate a differential pressure between the supply tank and the discharge tank.

23. A printing apparatus comprising:

the liquid supply system as defined in claim 22; and a medium conveyer configured to convey a medium.

24. A liquid flow method for causing a liquid to flow through a head;

the head having four groups each including a manifold extending in a first direction and a plurality of pressure chambers each connected to the manifold and a nozzle;

the four groups including a first group, a second group, a third group and a fourth group arranged in an order of the first group, the second group, the third group, and the fourth group in a second direction intersecting the first direction, the method comprising:

causing the liquid to flow from a first side to a second side in the first direction in the manifold included in each of two groups, of the four groups, constituting a group A;

causing the liquid to flow from the second side to the first side in the first direction in the manifold included in each of remaining two groups, of the four groups, constituting a group B;

the first group and the third group constitute the group A and the second group and the fourth group constitute the group B, or the first group and the fourth group constitute the group A and the second group and the third group constitute the group B.

25. The method according to claim 24, wherein the first group and the third group constitute the group A and the second group and the fourth group constitute the group B.

26. The method according to claim 24, wherein the first group and the fourth group constitute the group A and the second group and the third group constitute the group B.

27. The method according to claim 24, wherein:

the liquid is caused to flow at a velocity V1 from the first side to the second side in the first direction in the manifold included in each of the two groups constituting the group A;

the liquid is caused to flow at a velocity V2 from the second side to the first side in the first direction in the manifold included in each of the two groups constituting the group B; and the velocity V1 is identical to the velocity V2.

* * * * *